US010934707B2

(12) United States Patent
Claeys

(10) Patent No.: US 10,934,707 B2
(45) Date of Patent: Mar. 2, 2021

(54) CURTAIN WALL WITH A WALL ELEMENT WITH A FRAME WITH A COMPARTMENT FOR A WING OR THE LIKE AND METHOD FOR REPLACING AN INFILL ELEMENT IN A CURTAIN WALL

(71) Applicants: Stephanie Catharina R. Claeys, Zandhoven (BE); Laurens Leonard J. Claeys, Zandhoven (BE); Nausikaa Els P. Claeys, Zandhoven (BE)

(72) Inventor: Eric Claeys, Zandhoven (BE)

(73) Assignees: Stephanie Catharina Claeys, Zandhoven (BE); Laurens Leonard J. Claeys, Zandhoven (BE); Nausikaa Els P. Claeys, Zandhoven (BE)

( * ) Notice: Subject to any disclaimer, the term of this patent is extended or adjusted under 35 U.S.C. 154(b) by 0 days.

(21) Appl. No.: 16/337,456

(22) PCT Filed: Oct. 20, 2017

(86) PCT No.: PCT/IB2017/056532
§ 371 (c)(1),
(2) Date: Mar. 28, 2019

(87) PCT Pub. No.: WO2018/073800
PCT Pub. Date: Apr. 26, 2018

(65) Prior Publication Data

US 2019/0234071 A1 Aug. 1, 2019

(30) Foreign Application Priority Data

Oct. 21, 2016 (BE) ..... 2016/5794
Oct. 27, 2016 (BE) ..... 2016/5809

(51) Int. Cl.
*E04B 2/96* (2006.01)

(52) U.S. Cl.
CPC ..... *E04B 2/967* (2013.01)

(58) Field of Classification Search
CPC ..... E04B 2/967; E04B 2/96; E06B 3/6715; E06B 3/5427
See application file for complete search history.

(56) References Cited

U.S. PATENT DOCUMENTS 5,452,552 A 9/1995 Ting
5,839,236 A 11/1998 Frey
(Continued)

FOREIGN PATENT DOCUMENTS

CL 201401909 7/2013
DE 102010002544 B3 8/2011
(Continued)

OTHER PUBLICATIONS

International Search Report in related PCT/IB2017/056532, dated Mar. 12, 2018.
(Continued)

*Primary Examiner* — Beth A Stephan
(74) *Attorney, Agent, or Firm* — Bacon & Thomas, PLLC

(57) ABSTRACT

A curtain wall constructed from prefabricated connecting wall elements including a frame of assembled profiles on the inside of the curtain wall and of one or more filling elements on the outside. The curtain wall contains a wall element with a two-part frame including two subframes, respectively a fixed frame part and a second frame part fitted with an infill element, where the fixed frame part is located behind the second frame part seen from the outside of the curtain wall, where the fixed frame part is equipped with a rebate into which the second frame part fits and where the relevant filling element is attached to the outside of the curtain wall on the outward looking side of the second frame part using
(Continued)

structural silicone in such a way that this outside of the second frame part is entirely covered by the filling element.

26 Claims, 25 Drawing Sheets

(56) References Cited

U.S. PATENT DOCUMENTS

| | | | | |
|---|---|---|---|---|
| 8,991,121 | B1 | 3/2015 | Baker | |
| 2011/0167743 | A1* | 7/2011 | Ting | E04B 2/96 52/235 |
| 2012/0210664 | A1 | 8/2012 | Lang et al. | |
| 2015/0267460 | A1 | 9/2015 | Header | |
| 2015/0284950 | A1 | 10/2015 | Stramandinoli | |
| 2015/0284951 | A1 | 10/2015 | Frederick | |

FOREIGN PATENT DOCUMENTS

| | | | | |
|---|---|---|---|---|
| EP | 641902 | A1 * | 5/1994 | E04B 2/96 |
| EP | 0641902 | A1 | 3/1995 | |
| EP | 1437449 | A2 | 7/2004 | |
| KR | 101685608 | | 12/2016 | |
| WO | 9942692 | | 8/1999 | |
| WO | 2010043862 | A2 | 4/2010 | |
| WO | 2013109725 | | 7/2013 | |

OTHER PUBLICATIONS

Written Opinion in related PCT/IB2017/056532, dated Mar. 12, 2018.

Belgium Search Report in related Belgium Application No. 201605809, dated May 23, 2017.

Chilean Office Action in corresponding Chilean Application No. 201901035, dated Feb. 11, 2020 (Part 1).

Chilean Office Action in corresponding Chilean Application No. 201901035, dated Feb. 11, 2020 (Part 2).

Chilean Office Action in corresponding Chilean Application No. 201901035, dated Feb. 11, 2020 (Part 3).

Eurasian Office Action in corresponding Eurasian Application No. 201990963, dated Mar. 6, 2020.

Chilean Examination Report in corresponding Chilean Application No. 201901035, dated Feb. 2, 2020.

Chilean Examination Report in corresponding Chilean Application No. 201901035, dated Aug. 11, 2020.

Chinese Office Action in corresponding Chinese Application No. 2017800643027, dated Jun. 23, 2020.

Columbian Examinees Opinion in corresponding Columbian Application No. NC2019/0003888, dated Jul. 23, 2020.

* cited by examiner

CURTAIN WALL WITH A WALL ELEMENT WITH A FRAME WITH A COMPARTMENT FOR A WING OR THE LIKE AND METHOD FOR REPLACING AN INFILL ELEMENT IN A CURTAIN WALL

The present invention relates to a modular curtain wall or so-called unitized curtain wall.

It is well-known that unitized curtain walls are commonly constructed in a modular fashion using rectangular prefabricated wall elements which are connected to each other sideways with seals in horizontal rows placed one above the other.

The invention more particularly relates to a type of curtain wall in the form of a so-called unitized curtain wall with wall elements consisting of a frame or so-called module of assembled aluminium profiles on the inside of the curtain wall which define one or more open compartments which must be filled with infill elements.

BACKGROUND OF THE INVENTION

In the case of a unitized curtain wall it is necessary to distinguish between, on the one hand, the structure, in other words the structural profiles of the unitized curtain wall which are assembled to form a whole, the so-called modules or frames.

It is necessary to provide a "filling" for the "openings" in the empty "compartments" in these frames, or modules, in the unitized curtain wall.

There are 3 options for the "filling" of the empty compartments, namely an infill element in the form of fixed see-through glazing, or a fixed blind panel, or a unit that opens with a door or a window.

As is the case for all windows, a window that can be opened normally consists of a fixed external frame and a wing that opens which "hangs" in the fixed external frame using window hardware.

It goes without saying that the external surface of the glazing of a fixed compartment needs to be aligned with the surface of a wing that opens.

If the fixed external frame part is "integrated" in the module of the unitized curtain wall it is still necessary to provide a wing that opens "somewhere or other" to contain the glazing of the window that opens.

By definition, such a wing has a specific flush-mounting depth and, on the other hand, needs to be fitted with window hardware placed in the rebate.

Both the vertical profiles and also the horizontal profiles of the module are such that the inside of fixed glazing rests against the rubbers placed in the appropriate grooves in these profiles.

This implies that it is impossible to flush-mount a wing without the surface of the glass protruding outside.

The profile system according to the invention is now construed so that:

- in the case of fixed glazing or a fixed panel, the inside rests upon the fixed inside rubbers contained in the grooves of the rubbers;
- the mullion has been developed in such a way that by grinding away over the entire height—and only there, not higher or lower—the required rebate with all the profiling is left allowing a wing to be flush-mounted whereby the external surface of the glazing is aligned with that of the compartments with a fixed infill element;

- in the case of a mullion this is necessary because there is almost automatically a fixed compartment above and below a wing and, by definition, the mullion extends over the entire height of a module;
- in the case of a transom this is not necessary since, by definition, a transom is found between two mullions and it is therefore easier to create a separate transom with the profiling for installation of fixed glazing on the one side and the required rebate for the installation of the wing profile on the other.

In all the other existing systems in which a wing that opens can be flush-mounted, it is also necessary in the case of fixed glazing—and also in the case of the wings that open—to make a separate additional frame containing the fixed glazing, whose frame is then permanently attached to the module in some way or other, usually with screws, in which case without the window hardware as in the case of a wing. There is no other way, as indeed the vertical mullion continues over the entire height of the module.

Existing technologies have 2 great disadvantages:

- for each compartment in the wall consisting of frames with entire units that open, be these fixed or ones that open, it is necessary for a separate frame to be produced to contain the glazing, fixed or mounted on the module of the wall using hardware. This takes time and time is money, however not only time, but also material;
- bearing in mind that the number of parts that open in a wall are just a fraction of all wall compartments, it is clear that our solution represents a very significant saving since all fixed panels and all fixed glazing can be placed directly, in other words without separate glass frames, against the structure of the module.

The heart of the invention is that with the invention a part of the vertical mullion is removed by grinding, and only for a wing compartment, rather than producing a separate frame for all compartments and then mounting them against the module.

The system according to the invention therefore features:

- once again, no separate external frame for a window that opens;
- this so-called "external frame" is created by the profiles of the frame itself, whereby the mullions across the height of the wing are removed locally by grinding, thus creating the rebate;
- the horizontal and vertical profiles of the external frame are designed to operate in the best possible way, whereby no account is taken of how and in what way to carry out the connection of a horizontal with a vertical profile in a perfectly windproof and watertight manner, however;
- accomplishing the required wind and waterproof connection by using a specially-designed plastic instrument placed on the inside of a perpendicular corner piece, and which is therefore visible when the wing is opened, which causes no problem, and in doing so achieving a perfectly sealed connection without the use of any silicone or such material and whereby this connection is such that in the event of any distortion in the rectangular window opening, under whatever influence or for whatever reason, this connection will still always remain perfectly sealed due to the fact that it is not a rigid connection, but instead achieved using a semi-supple corner piece;
- this corner piece is attached in the factory and therefore under perfect quality control.

The invention is therefore more specifically intended for a curtain wall in the form of a unitized curtain wall featuring a combination of fixed infill elements and of infill elements for a wing that opens, whereby both the fixed and opening infill elements all need to be aligned.

U.S. Pat. No. 8,991,121 discloses a curtain wall with the normal classic thermally non broken unitized system in which the flush-mounting of wings that open is technically impossible.

WO 99/42692 discloses the construction of a wall with frames in which a mix of fixed and opening infill elements can be applied.

However, said WO 99/42692 concerns a wall of another type than a unitized curtain wall system with structural supporting frame modules as intended in the present invention.

On the contrary, WO 99/42692 refers to a so-called "cold-warm" wall consisting of "window bands" between concrete spandrels and in which insulation is applied in line with the spandrels and for this to be achieved by mounting a small frame with the single glass panel, whereby a ventilated cavity is provided. This kind of wall system requires a fully concrete wall provided with "openings" in order to fit the see-through glazing.

In this known system, the wind and waterproof seal level with the vertical reveals of the windows is ensured by a butyl band attached to the window and the concrete or stone reveal.

Furthermore, this kind of system by definition must also be mounted from the outside—so with the use of scaffolding!

It is known, in the case of curtain walls, that the glazing can be glued to the aluminium frame with the help of structural silicone and that the glass is therefore not clamped mechanically.

An advantage of prefabricated wall elements is that they can be fabricated under ideal and controlled conditions in a factory, which is obligatory under the relevant norms and regulations when it comes to structural glazing attached with a structural silicone.

The wall elements are such that the glued glazing or other infill elements entirely or almost entirely cover the outside of the frames so that it appears from the outside as if the curtain wall is made only of glass or other infill elements whereby the frame is hidden behind the infill elements. Therefore, on the outside one only sees a glass surface or other infill elements and nothing of the structure in any material.

Such wall elements are suspended in their entirety to the basic structure of the building and connect to each other to form one continuous outer wall, whereby a wall element covers the height of one storey at minimum and typically contains two infill elements stuck one on top of the other on the frame, namely one single infill element that is non-translucent or opaque and that covers the concrete slab or structure between the floors and a see-through infill element forming a window on the relevant floor.

SUMMARY OF THE INVENTION

The present invention aims to provide a solution for at least one of the aforementioned and other disadvantages.

To this end the invention concerns a curtain wall of the modular type, constructed from prefabricated connecting wall elements assembled in rows next to each other and above each other, characterised in that the wall elements consist of a basic frame or so-called module of mullions and transoms defining one or more open compartments which are filled using a fixed infill element that is attached directly to the basic frame or using a wing with an infill element attached to a wing frame that is attached in a rebate or the basic frame, whereby the infill elements are all aligned and whereby the mullions of the basic frames are formed using one-piece profiles with an internal chamber formed by an external wall and a side wall of the mullion, whereby in the case of a compartment of a fixed infill element the infill element is attached directly to the outside wall of the mullions and whereby in the case of a compartment of a wing the rebate in the mullions is achieved by locally removing the outside wall and side wall of the internal chamber of the mullions of the basic frame level with the compartment.

Therefore, only one single structural supporting basic frame or module is required, both for the frames with fixed infill elements and for the frames with a wing that opens, but whereby, in the case of a compartment with a wing, part of the mullions is removed locally by grinding or suchlike to form a rebate, but whereby above and below the rebate the mullion profile is left intact in order to be able to fix the transoms between them.

Knowing that in any case the number of parts that open are only a fraction of all wall compartments, it is clear that the solution according to the invention represents a very significant saving since all fixed panels and all fixed glazing can be placed directly, in other words without separate glass frames, against the supporting structure of basic frames.

An advantage of such a wall element according to the invention is that this wall element cannot be visually distinguished from the other wall elements with fixed infill elements on fixed basic frames, neither from the outside nor the inside of the curtain wall.

Another advantage is that, for a wall element with a wing that opens, no separate external frame is required around the infill element, meaning that the cost of such a frame is avoided. In the case of the invention, the so-called "external frame" is achieved as it were by the profiles or the basic frame itself, whereby the mullions are ground locally at wing height to a particular depth to create the required rebate.

The lack of external frame means there is no gap to fill between this external frame and the fixed frame on which it is mounted.

The wing frame of a wing that opens or of a replacement infill element can be composed of predominantly L-shaped profiles which are attached with a first leg along the edges of the infill element to the inside of this infill element and with the second leg at a distance from these edges.

Such a wing frame is easily made to measure to fit in the rebate of the basic frame in such a way that the infill element on this wing frame is aligned with the remaining fixed infill panels in the curtain wall.

Preferably, the wall elements and the wing frames of the infill elements that open are fitted with insulation profiles all around their perimeter which are attached to the frame and which reach outside to overlap over the edges of the infill elements to which they are sealed.

The basic frames of the supporting modules preferably consist of profiles which have perpendicular ends, whereby the transom profiles with their ends extend between the mullion profiles and are connected to said profiles with screws.

This significantly simplifies the fabrication of the basic frames compared to frames with mitre connections.

In order to achieve the required wind and watertight connection between a transom and a mullion in the corners of a compartment with a wing beneficial use is made of a specially-designed plastic instrument that is placed on the inside of a perpendicular corner piece, and therefore visible in an undisruptive manner when the wing is opened. In this way, a perfectly sealed connection is created without any use of silicone or other such material and whereby this connection remains perfectly sealed even in the event of any distortion in the rectangular window frame opening, under whatever influence or for whatever reason, since it is not a rigid connection, but instead one achieved using a semi-supple corner piece.

This corner piece is applied in the factory and therefore under perfect quality control.

A wall element with a basic frame with a compartment for a fixed infill element as described above, is also well suited as the replacement of a fixed infill element in a curtain wall according to the invention, for example due to a crack or for whatever other reason.

To this end the invention relates to a method comprising the following steps:

- the provision of a replacement infill element on a frame in the form of an aforementioned wing frame;
- the supporting of the infill element to be replaced from the inside to prevent it from falling out;
- the loosening of the infill element to be replaced from the inside by grinding or such like around the perimeter of the infill element, the side wall and connecting wall of the side chamber of the fixed frame to which the infill element is attached, and in that way creating a rebate;
- the removal of the loosened infill element from the inside with the part of the fixed frame that has been ground loose;
- the attachment from the inside of the replacement infill element with its wing frame in the rebate;
- the attachment from the inside of the wing frame of the replacement infill element.

An essential aspect in this method is that the entire operation to replace a damaged infill element can be conducted entirely inside the building using a wing frame with a new infill element and therefore that no technicians or fitters are required on the outside of the building or wall.

An advantage of this method is that it can be conducted entirely indoors without creating any risks to the safety of the fitters as it takes place within the building, as opposed to curtain walls of the known type where replacing a fixed infill element is a risky undertaking carried out on the outside of the building, not to mention a costly operation, certainly in the case of a curtain wall in which an infill element must be replaced at a great height.

Another advantage is that the wing frame can be made beforehand in the protected factory environment, which is particularly important for good adhesion of the structural silicone.

Preferably, attachment of the wing frame with the replacement infill element makes use of clips, which simplifies the assembly even more.

BRIEF DESCRIPTION OF THE DRAWINGS

With the intention of better showing the characteristics of the invention, a preferred embodiment of a modular curtain wall and adapted wall elements is described hereinafter, by way of an example without any limiting nature, with reference to the accompanying drawings wherein:

FIGS. 11 to 14 show cross-sections according to the lines XI-XI to XIV-XIV in FIG. 10, however in FIGS. 11 and 14 with a wing that opens;

DETAILED DESCRIPTION OF THE INVENTION

Figure 1:
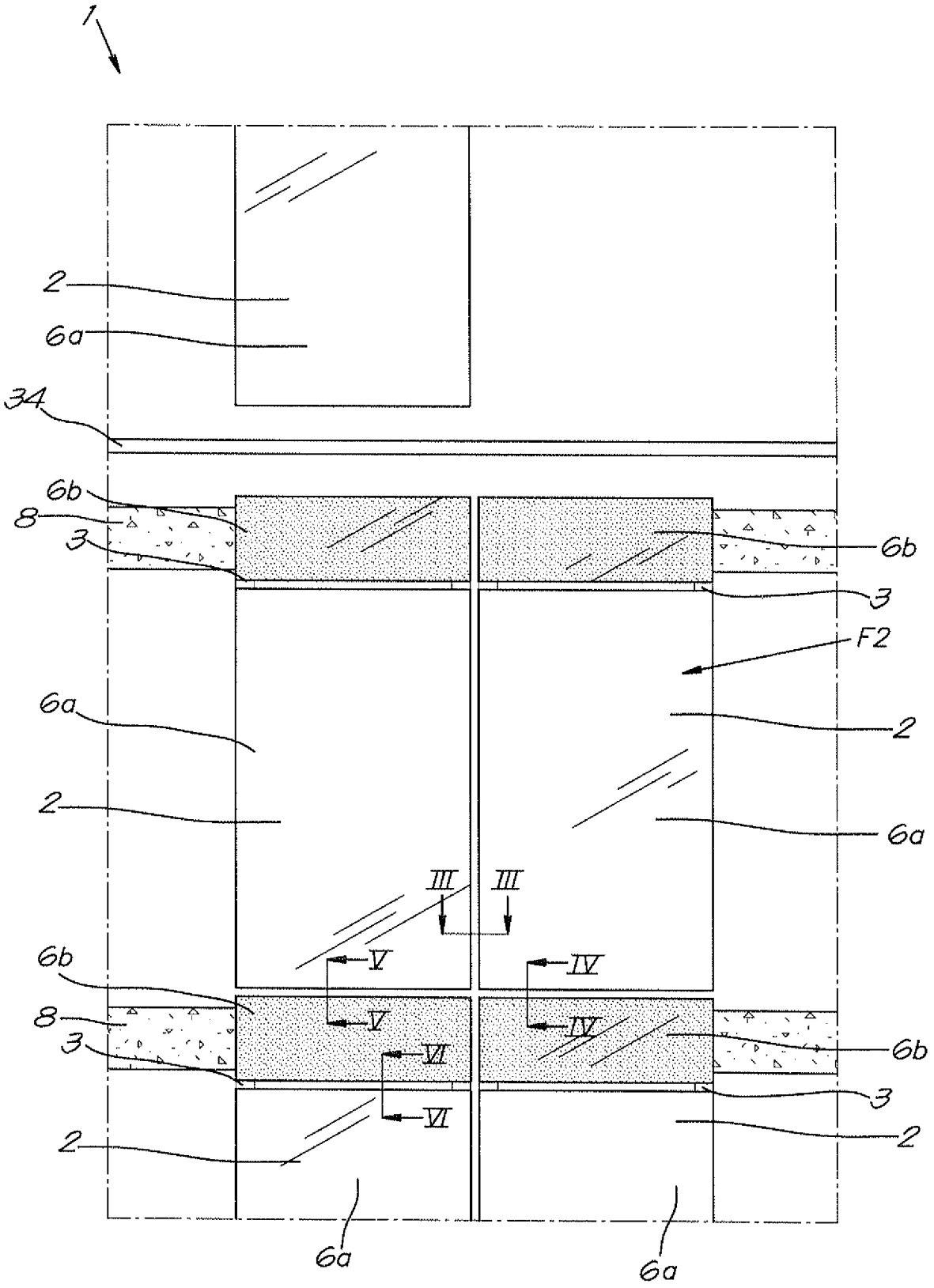
FIG. 1 schematically shows an external view of a curtain wall according to the invention being constructed with a partial cutaway.

The curtain wall 1 shown in FIG. 1 is a curtain wall of the modular type constructed from individual prefabricated rectangular wall elements 2 in the form of separate modules placed in rows next to and above one another to create a level wall, forming the supporting structure of the curtain wall 1.

Figure 2:
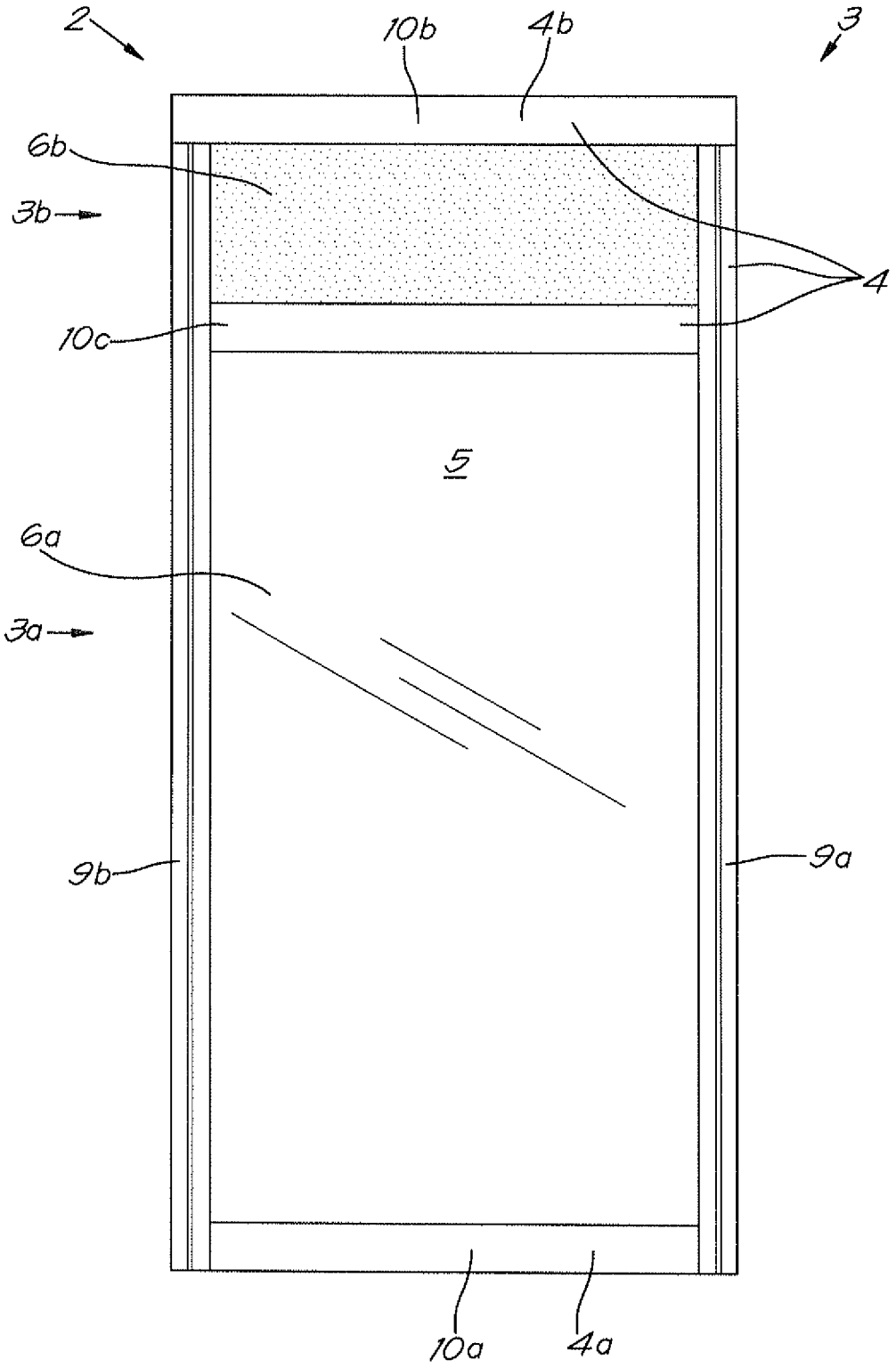
FIG. 2 shows an internal view of a wall element as indicated with F2 in FIG. 1.

As is apparent in FIG. 2 the wall elements 2 or modules are composed of a basic frame 3 of assembled one-piece profiles 4 on the inside 5 of the curtain wall 1 and of rectangular infill elements 6 on the outside 7 of the curtain wall 1 which almost entirely cover the basic frame 3, whereby the basic frame 3 is therefore hidden behind the infill elements 6 so that it appears as if the outside 7 of the curtain wall 1 consists entirely of infill elements in glass or suchlike.

The wall elements 2 are suspended on a basic structure at floor height 8, whereby a wall element 2 spans the height of a storey.

Preferably, the wall elements 2 are fitted with two infill elements, being a see-through infill element **6*a* at floor level and preferably a non-translucent or opaque infill element 6*b* to conceal the thickness of the floors 8**.

In the example in the figures the infill elements 6 are formed by triple glazing although this is not essential.

Frame 3 is constructed from one-piece mullions 9 and one-piece transoms 10, whereby the transoms 10 have perpendicular ends and are connected with the mullions 9 using screws 11.

Figure 3:
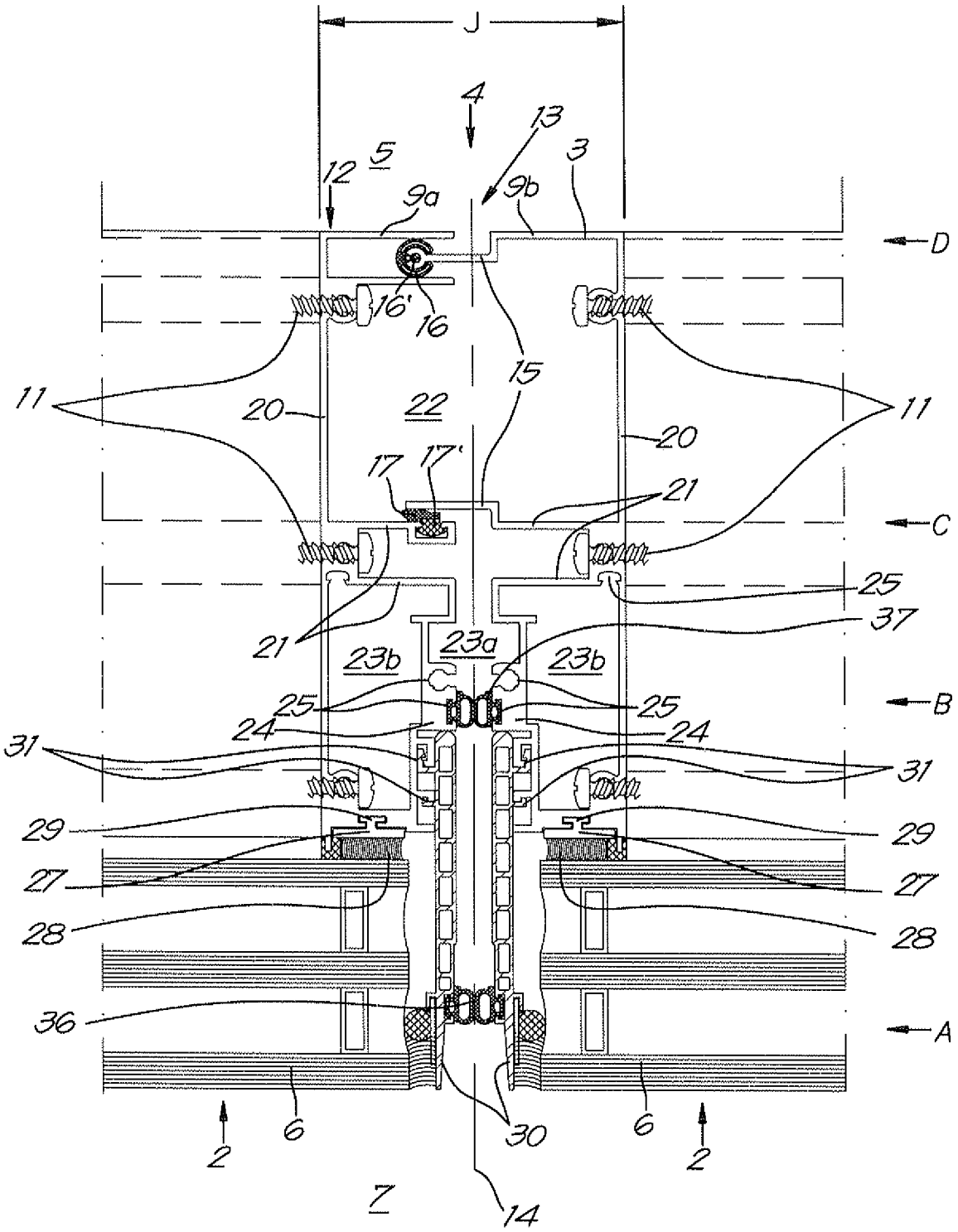
FIG. 3 shows a cross-section according to the line III-III in FIG. 1.

As illustrated in FIG. 3 the basic frame 3 contains two types of mullions 9 that fit inside each another telescopically, respectively a mullion 9*a* with an open U-shaped female coupling part 12 and a mullion 9*b* with a complementary open U-shaped male coupling part 13, whereby the two types of mullions 9*a* and 9*b* slide with their coupling parts telescopically inside each other and whereby these mullions 9*a* and 9*b*, with the exception of the coupling parts, are as good as symmetrical relative to a median plane 14.

The mullions 9*a* and 9*b* of adjacent wall elements 2 are coupled to each other as shown in FIG. 3 and thus form in their coupled state a composite rectangular beam-shaped basic profile 4, as it were, consisting of two predominantly symmetrical semi-profiles 9*a* and 9*b* for the mullions and 10*a* and 10*b* for the transoms 10.

In the example the male coupling part 13 is formed by two parallel legs 15 which grasp between parallel walls of the female part 12 and are sealed off using seals 16 and 17 on the free end of the legs 15.

These seals are preferably formed by co-extrusion of one or two materials, respectively a rubber or suchlike and a stiff material to form a stiff foot 16' and 17' which allows the seal to be slid in the lengthways direction into the appropriate detailing during assembly of the frame 3.

In the example of the figures, the basic frame 3 contains three transoms 10, featuring a lower transom 10*a*, an upper transom 10*b* and one or more intermediate transoms 10*c*, in this case just one intermediate transom 10*c*, whereby the lower transom 10*a* and the one or more intermediate transoms 10*c* are mounted between the mullions, while the upper transom 10*b* is mounted on the mullions 9.

Figure 4:
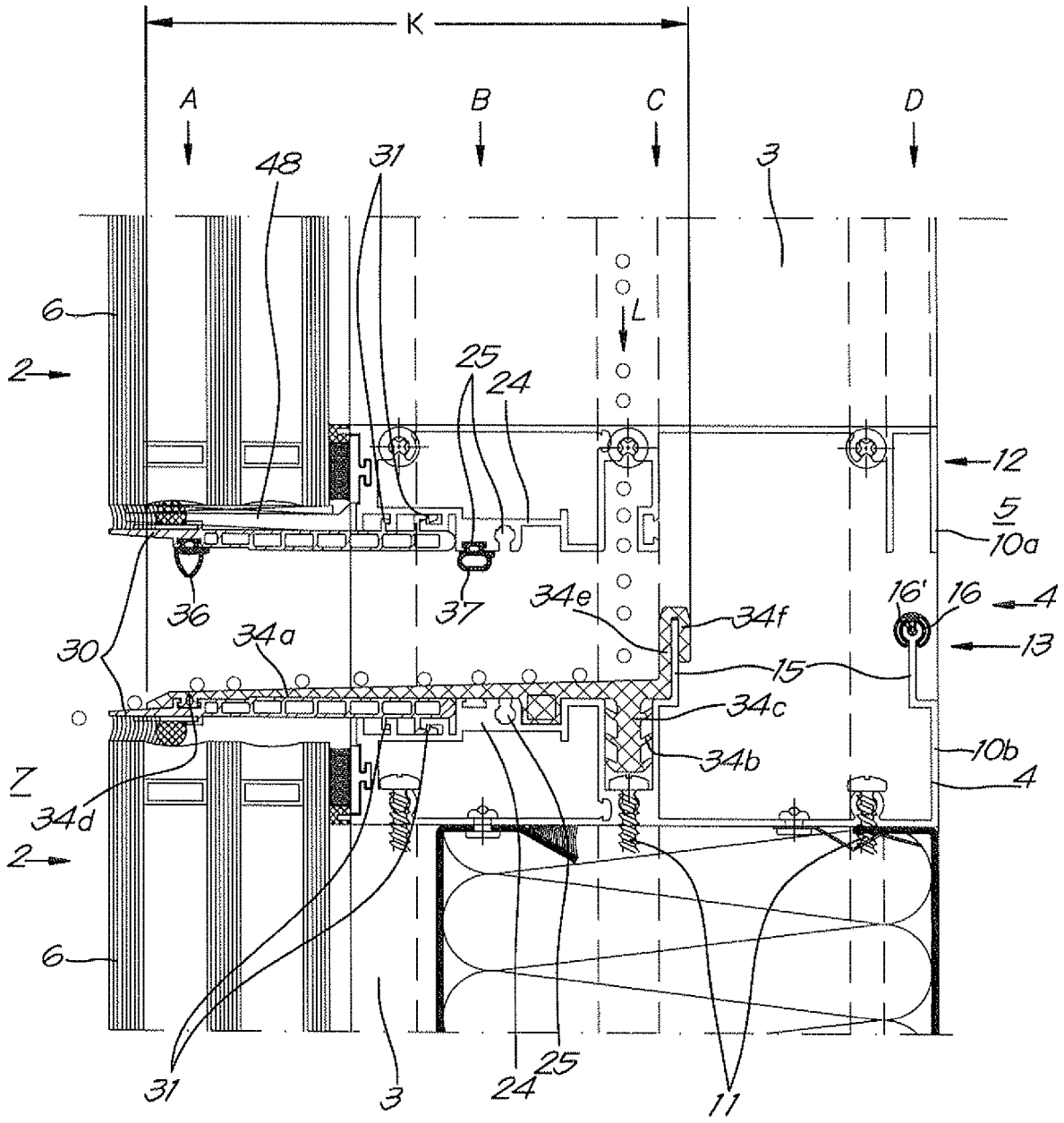
FIG. 4 shows a cross-section according to the line IV-IV in FIG. 1, yet in disassembled state.
Figure 5:
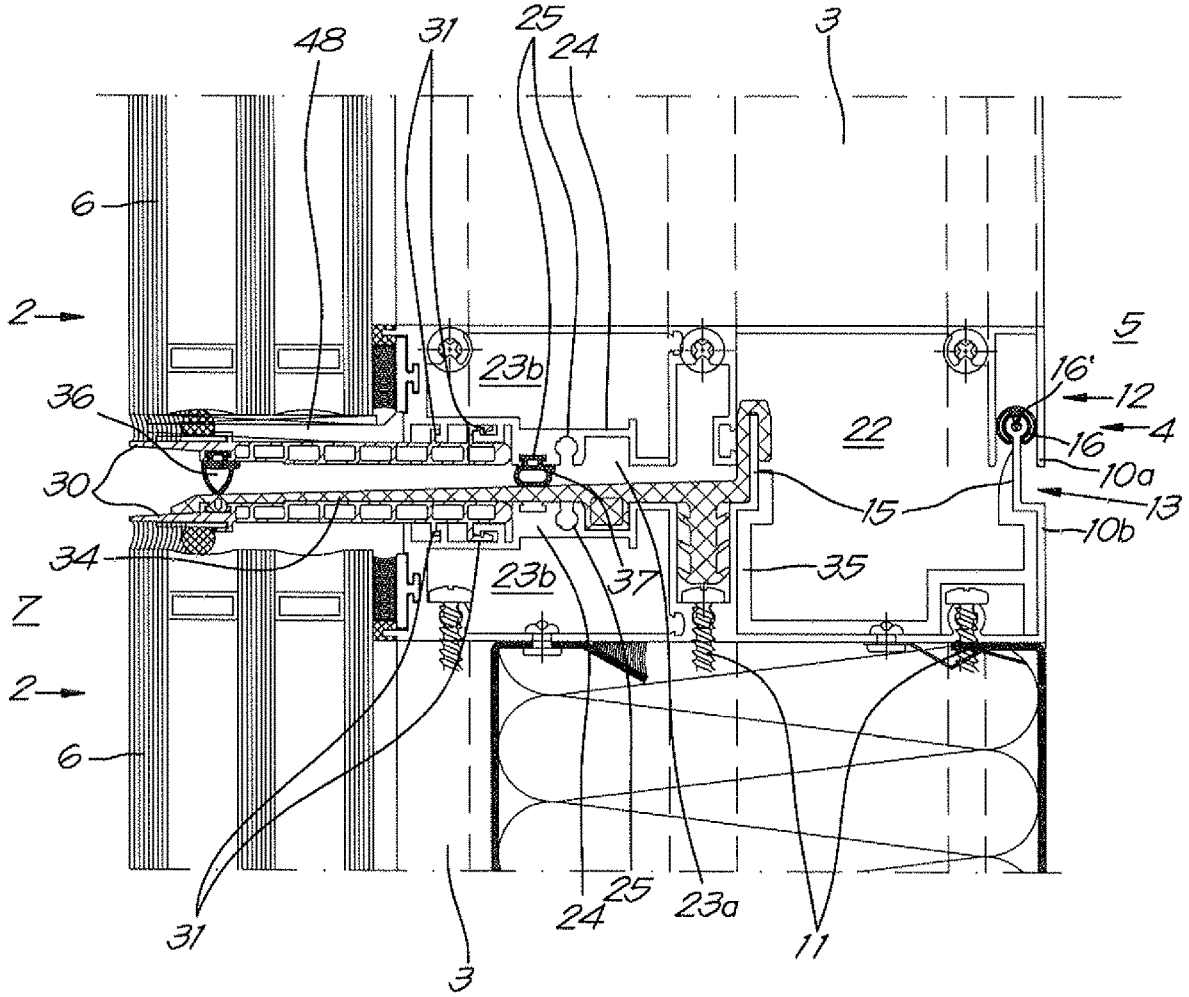
FIGS. 5 and 6 show cross-sections, respectively according to the lines V-V and VI-VI in FIG. 1.

In terms of profiling the upper transom 10*a* and the lower transom 10*b* are identical to the profiles of the mullions 9*a* and 9*b* and fit together in the same telescopic manner as shown in the FIGS. 4 and 5, whereby the lower transom 10*a* features a downward facing female coupling part 12 and the upper transom 10*b* features an upward facing male coupling part 13 that, when assembled, extends into the female coupling part 12 of a higher wall element 2. Just as the mullions 9*a* and 9*b*, the transoms 10*a* and 10*b* unite to form a composite profile 4 that, in terms of shape, is predominantly in line with the aforementioned basic profile 4.

Figure 6:
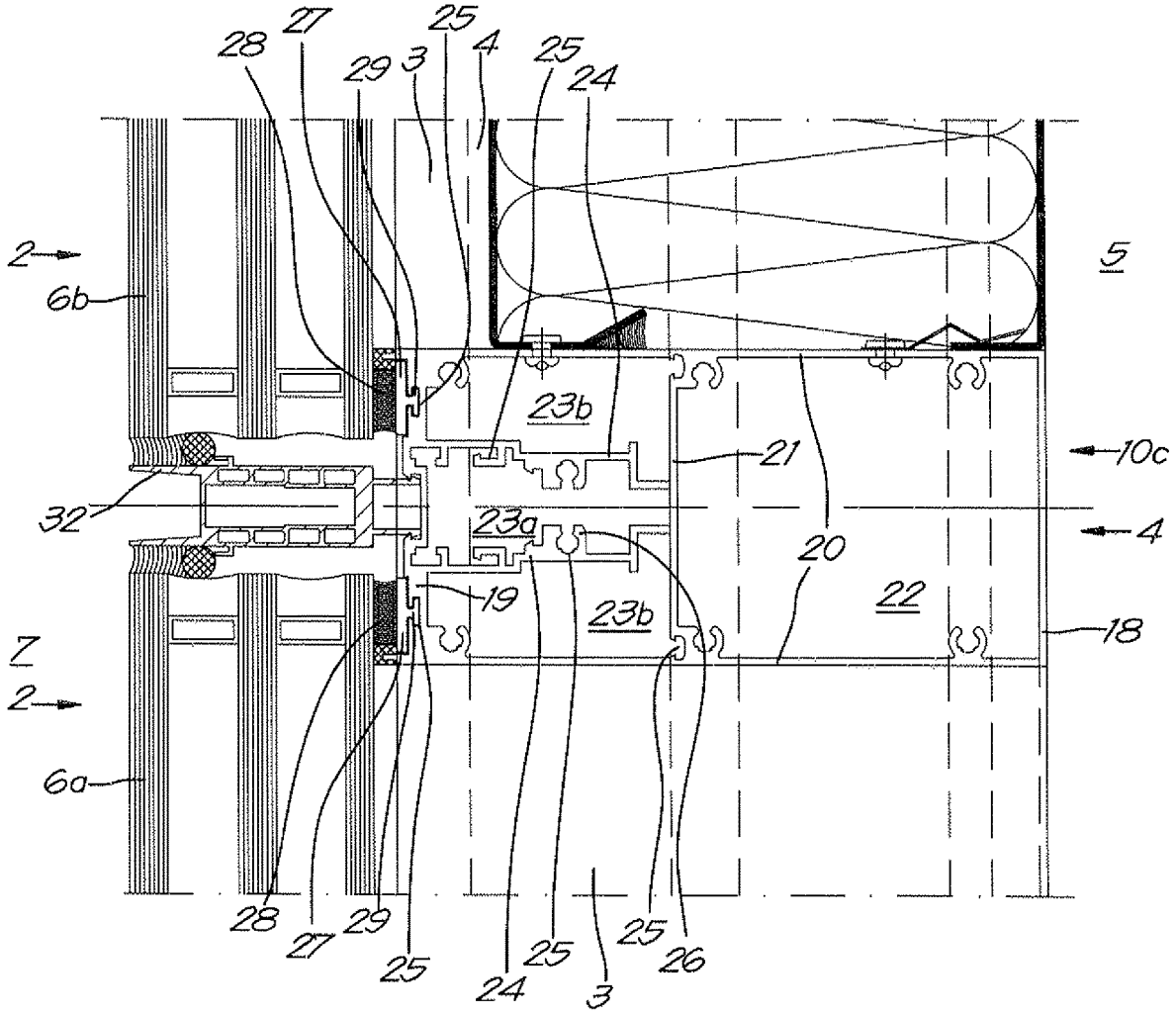
Figure 7:
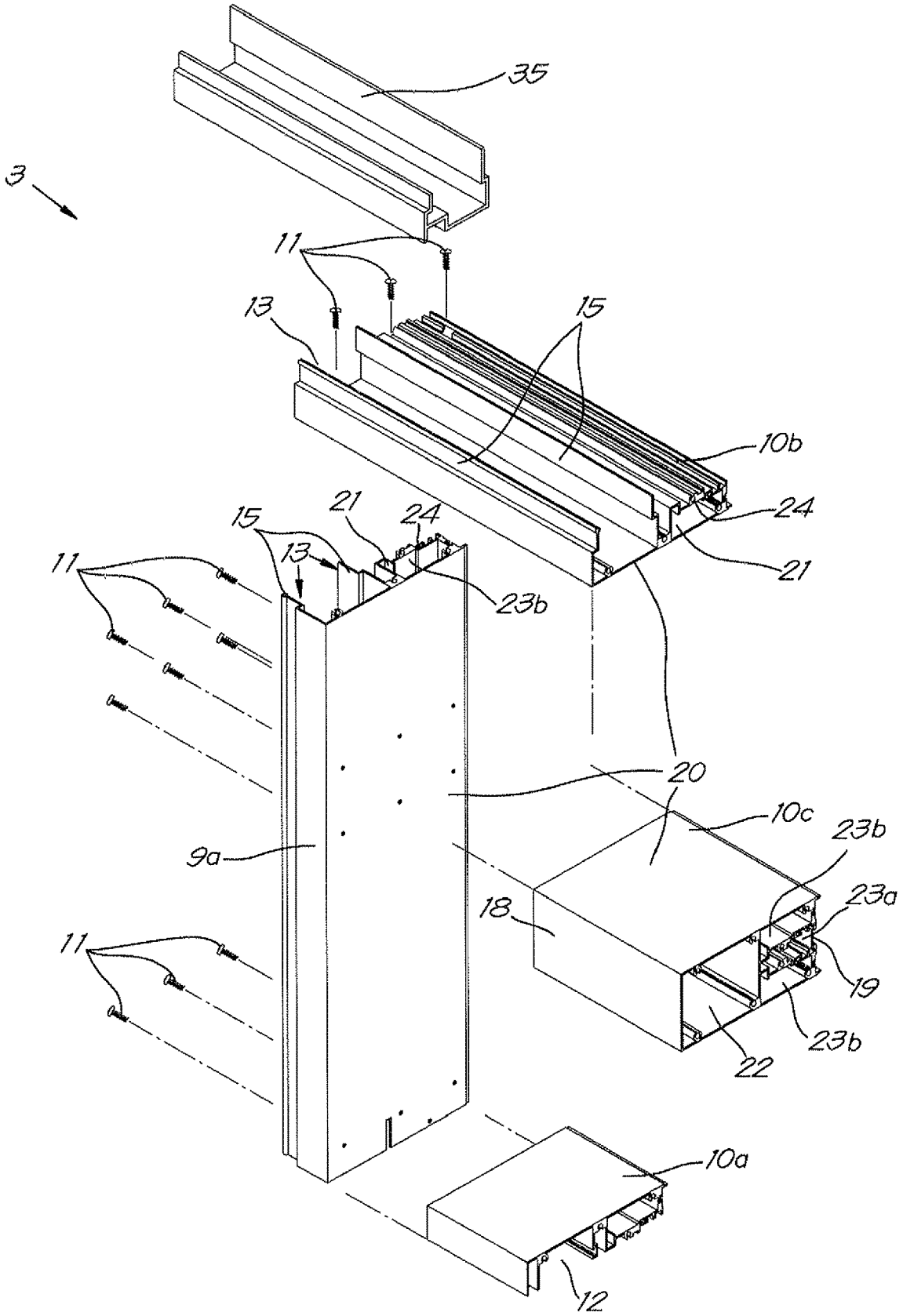
FIGS. 7 to 9 show in perspective and in disassembled state certain component parts of a wall element such as that of FIG. 2.

The intermediate transom 10*c* divides the frame 3 into two compartments 3*a* and 3*b* and has a cross-section as illustrated in FIG. 6 which in profiling terms, with the exception of the female and male coupling parts, is predominantly aligned with the composite basic profile 4.

The frame structure of the curtain wall 1 consequently appears to be composed exclusively of identical basic profiles 4, regardless of whether it is composed for the composite mullions 9*a* and 9*b* and transoms 10*a* and 10*b* or for the intermediate transoms 10*c*.

The basic profile 4 in FIG. 6 in line with an intermediate transom 10*c* is a rectangular tube profile with an inside wall 18 and an outside wall 19, i.e. an inside wall 18 facing the inside 5 of the curtain wall 1 and an outside wall 19 facing the outside 7 of the curtain wall 1 against which the infill elements 6 are attached, whose walls 18 and 19 are connected to each other by two parallel side walls 20.

The basic profile 4 is divided into two chambers using a partition 21 at a distance from the inside wall 18 and from the outside wall 19, respectively an inside chamber 22 on the inside 5 of the curtain wall 1 and an outside chamber 23 on the outside 7 of the curtain wall 1, whereby the outside chamber 23 is subdivided using two connecting walls 24 between the outside wall 19 and the partition 21 into three internal chambers, respectively into a middle chamber 23*a* and two internal side chambers 23*b* on each side of the middle chamber 23*a*.

As shown in FIGS. 4 and 5 the composite mullions 9 and transoms 10 substantially contain the same characteristics with the difference that the inside chamber 22 is now formed by the female and male coupling parts 12 and 13 which engage with each other and that the middle chamber 23*a* is now open and the partition 21 is realised with a double wall and divided into two parts.

The internal side chambers 23*b* are thus contained by 4 walls, namely by an outside wall 19, a side wall 20, a partition 21 and a connecting wall 24.

The connecting walls 24 of the internal side chambers 23*b* feature identical yet symmetrical detailing 25 on the sides facing each other for the attachment of seals or other components plus a protruding part 26.

Also, the outside wall 19 is fitted with detailing 25 at the level of the middle chamber 23*a* and, at the level of each internal side chamber 23*b*, with detailing 25 in the form of T-shaped recesses provided for the attachment of the infill elements 6 using aluminium slats 27 which are glued all the way around the inside of the infill elements 6 with structural silicone 28, for example structural silicone, whereby the slats 27 feature a T-shaped foot 29 which can be slid to fit into an aforementioned T-shaped recess. The slats 27 need to undergo an individual check to ensure that their surface treatment will not come loose when used in structural glazing.

Also, the partition 21 features detailing 25 on the inside of the internal side chamber 23*b* for assembly of seals or suchlike.

The transoms 10 and mullions 9 resemble semi-profiles 10*a* and 10*b*, respectively 9*a* and 9*b*, of the basic profile 4 featuring the same detailing 25.

Figure 8:
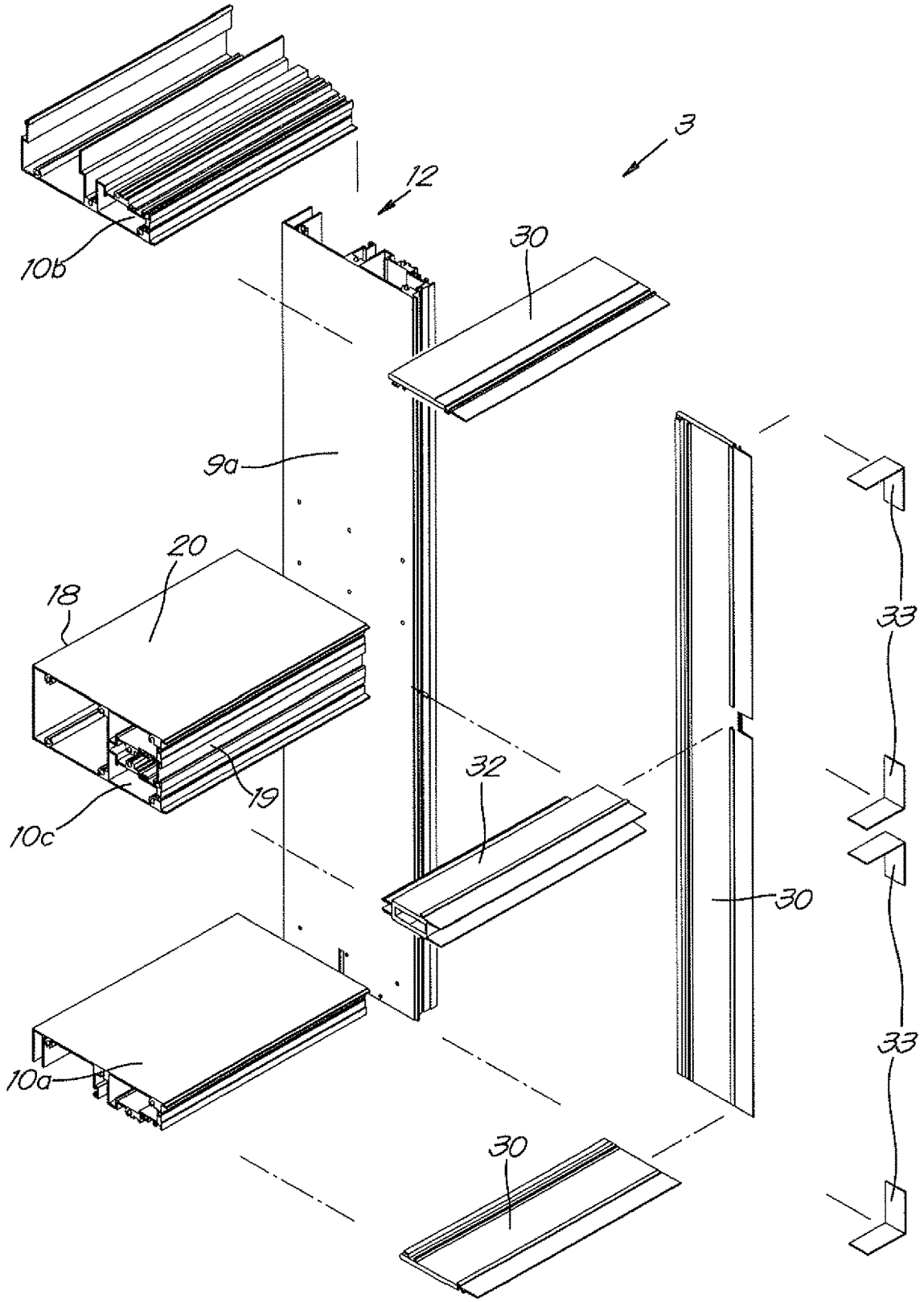

Around the perimeter of the infill element 6 insulation profiles 30 and 32 are fitted which, as shown in FIG. 8, are attached to mullions 9 and transoms 10 of the basic frame 3 using hooks 31 which, as shown in the FIGS. 3 and 4, are clicked into place in the specially-made detailing 25 on the connecting walls 24.

On the intermediate transom 10*c* an insulation profile 32 is attached as shown in FIG. 6, which connects the insulation profile 32 with the insulation profiles 30 of the mullions 9.

In the corners the insulation profiles 30 are joined together and the insulation profiles 30 of the mullions 10 are connected with the insulation profile 32 of the intermediate transom 10*c* using L-shaped corner connectors 33 as shown in FIG. 8 whose legs slide into the hollow insulation profiles 30 and 32.

The insulation profiles 30 and 32 extend from the frame 3 to the outside 7 of the curtain wall 1 over the thickness of the edges of the infill elements 6 and are sealed at their outward facing free ends in relation to the infill elements 6 using a silicone or other sealing kit.

As shown in FIG. 5, between two rows of connecting wall elements 2 a horizontal seal 34 is attached, which extends continuously in a horizontal direction over the breadth of the curtain wall 1 or a part of this wall and in doing so continues over the mullions 9 between neighbouring connecting wall elements 2, covering at least the corner connections between the mullions 9 and the transoms 10 of connecting wall elements 2.

This horizontal seal 34 is attached during construction of the curtain wall 1, as soon as a complete row of wall elements 2 or a part of such is constructed, on top of the row of wall elements 2 across the entire length of the row, after which assembly of a following row of wall elements 2 can begin as shown in FIG. 1 by clamping the horizontal seal 34 on the wall elements 2 below with the help of the profiling 34*b* and 34*d* without requiring other means of attachment such as screws or suchlike.

The horizontal seal 34 is a one-piece profile made of EPDM rubber or suchlike with a predominantly flat part 34*a* that rests on top of the row of wall elements 2 below and continuously covers the insulation profiles 30 of the wall elements 2 across the connecting perpendicular corner connections between the mullions and transoms of connecting wall elements 2 and this without making cuts or extra drilling and without any silicone.

This kind of EPDM rubber seal has the advantage of being a supple seal which can, for example, be rolled onto a roll and can then simply be rolled off this roll onto the wall elements 2 below and clamped together with the profilings 34*b* and 34*c* on the wall elements 2.

The length of the applied horizontal seals 34 are therefore required to be greater than the breadth J of the composite mullions 9*a*-9*b* as shown in FIG. 3 and is preferably such that several wall elements 2, preferably all wall elements 2, in a row of wall elements 2 can be bridged with this horizontal seal 34.

Should the length of a horizontal seal 34 be insufficient to cover the entire length of the row below, then use shall be made of several lengths of such a seal 34 connecting inside the breadth of a higher wall element 2 where there is no danger of a leak occurring at the side of this connection and where both extremities of the horizontal seal 34 are stuck together or vulcanised.

The top side of the flat part 34*a* slopes down towards the outside 7 of the curtain wall 1 to allow the good transit of water.

Preferably, the breadth K of the horizontal seal 34 is such that it stretches from the aforementioned most outward located leg 15 to or almost to the outside 7 of the curtain wall 1, so that, when in situ, this horizontal seal 34 acts as a sort of sill for the drainage of rainwater towards the outside 7 of the curtain wall 1.

Any infiltration water that might possibly infiltrate via the vertical joints will be carried away row by row via the underlying horizontal seal 34 towards the outside 7 of the curtain wall 1 as shown with indication L in FIG. 4. For the attachment of the horizontal seal 34 the flat part 34*a* on the underside is fitted with a downward facing profiling 34*b* which, as illustrated in FIG. 4, is fitted with barbs and which clamps tight into a groove contained by the walls or the double wall partition 21 of the underlying transom 10*b*.

The outward facing edge of the horizontal seal 34 is fitted with a first detailing 34*d* with which the seal 34 can be attached to the underlying insulation profile 30 and with a second detailing more towards the inside 5 of the curtain wall 1. In this way, the horizontal seal 34 is clamped onto an underlying wall element 2 in 3 places.

Furthermore, the horizontal seal 34 is made with an upstanding edge 34*e* of a height of for example 20 mm which extends into the female coupling part 12 of the lowest transom 10*a* of the wall elements 2 above and which clamps and seals between this female coupling part 12 and the upwardly extending leg 15 inside of the male coupling part 13 that is located closest to the outside 7 of the curtain wall 1.

The upstanding edge 34*e* keeps out any infiltration water and is fitted at the top with a hook-shaped bent end 34*f* that grasps the aforementioned upstanding leg 15.

At the level of the uppermost corners of connecting wall elements from an underlying row, the sideways connecting wall elements are connected together using a coupling profile 35 as shown in FIG. 5 in order to perfectly align the connecting wall element to ensure that the infill elements 6 on the outside 7 of the curtain wall 1 form a single surface.

Figure 9:
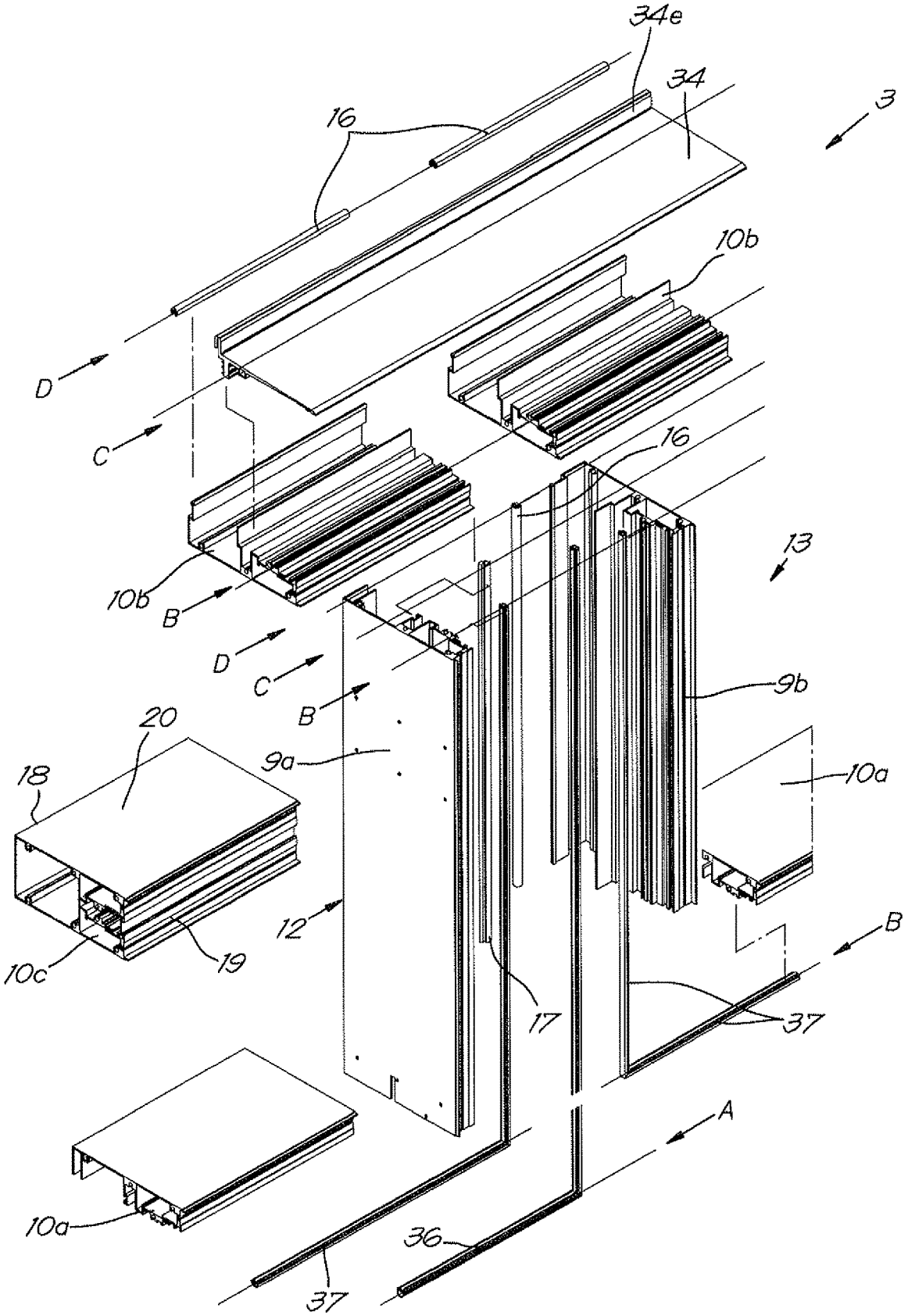

The wall elements 2 are sealed depth-wise along their perimeter from the outside 7 to the inside 5 of the curtain wall 1 on four levels A, B, C, D against each other as shown in the FIGS. 3, 4 and 9.

A first level A closest to the outside 7 of the curtain wall 1 is formed by first seals 36 which are attached respectively to the insulation profiles 30 of the mullions 9 and of the lowest transom 10*a*.

The second level B is formed by second seals 37 which are attached to the mullions 9 and to the lowest transom 10*a* of the basic frame 3 in a detailing 25 of the connecting walls 24.

The first and second seals 36 and 37 on the mullions seal each other, while the first and the second seals 36 and 37 seal the lowest transom 10*a* on the underlying horizontal seal 34.

The third level C is formed by the upstanding edge 34*e* of the horizontal seal 34 and by the aforementioned seals 17 between the female and male coupling parts 12 and 13.

The innermost fourth level is formed by the aforementioned seals 16 between the female and male coupling parts 12 and 13.

In this way a perfect water and airtight seal is achieved between the wall elements 2 and thanks to the continuous horizontal seal 34 also between the rows, whereby each row is isolated from another row in terms of water drainage and all the water from each row is transported via the horizontal seal 34 towards the outside 7 of the curtain wall 1.

Figure 10:
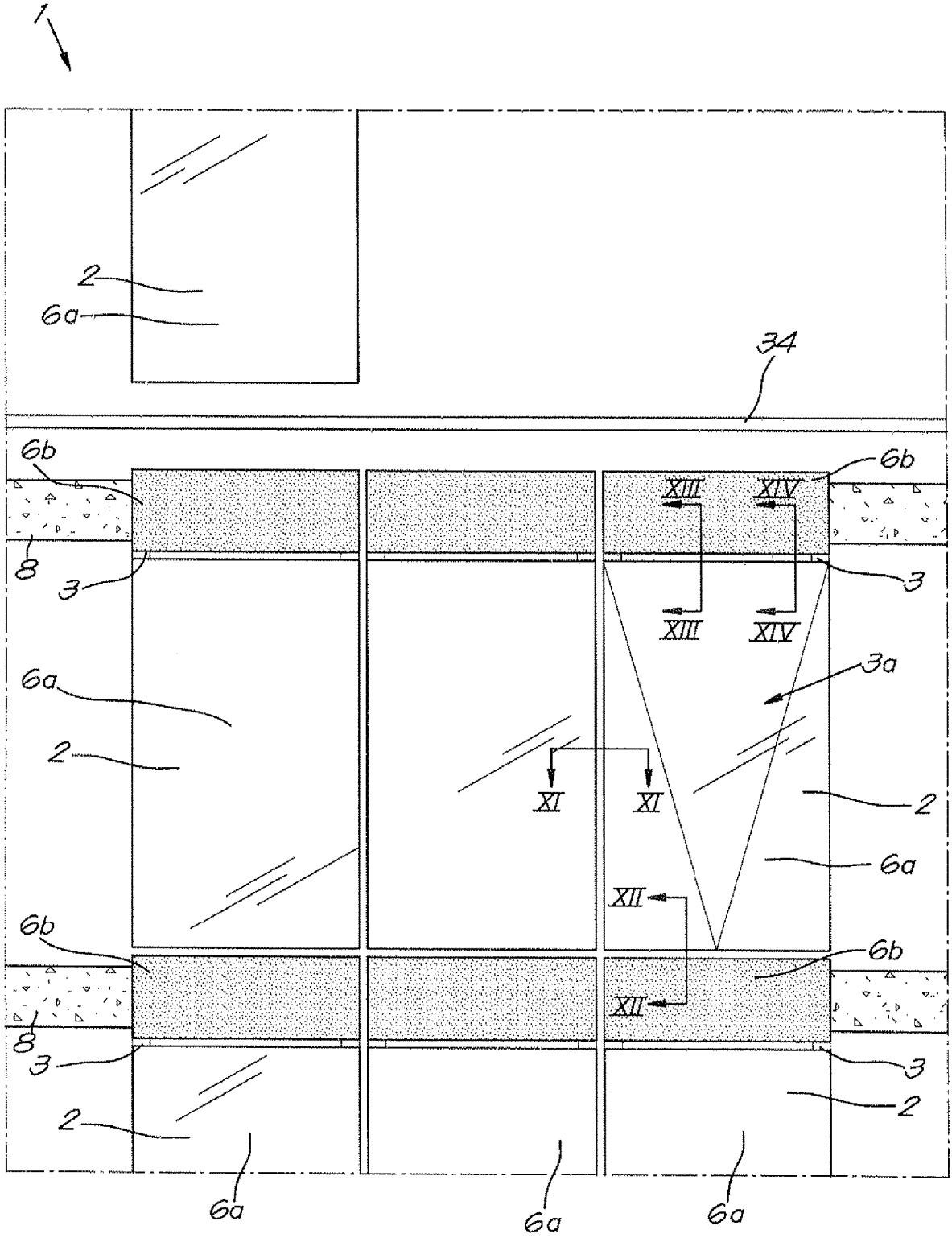
FIG. 10 shows a situation such as the one in FIG. 1 but whereby a wall element according to the invention is added with a wing that opens.

FIG. 10 shows a curtain wall 1 according to the invention whereby beside the wall elements 2 with fixed infill elements 6 a wall element 2 is now also fitted of which the one compartment 3*a* of the basic frame 3 is fitted with an outward-opening wing of a window while compartment 3*b* features a fixed infill element 6*a*.

The wing that opens is composed of a wing frame 3" and, attached to this wing frame 3", an infill element 6*a* that is fixed to the outside 7 of the wing frame 3" using structural silicone 28.

In terms of dimensions, the infill panel 6*a* of the wing is the same size as a fixed infill panel 6*a* and covers the wing frame 3" entirely or as good as entirely and is aligned with the other infill panels 6, so that no difference can be seen from the outside 7 of the curtain wall 1 between fixed infill panels 6 and infill panels of a wing.

When closed, the wing lies in a rebate 40 fitted along the perimeter of the compartment 3*a* of the wing in the basic frame 3, whereby this rebate 40 is formed by the fact that part of the internal chamber 23*b* of the mullions 9 and transoms 10 is missing or has been removed.

Figure 16:
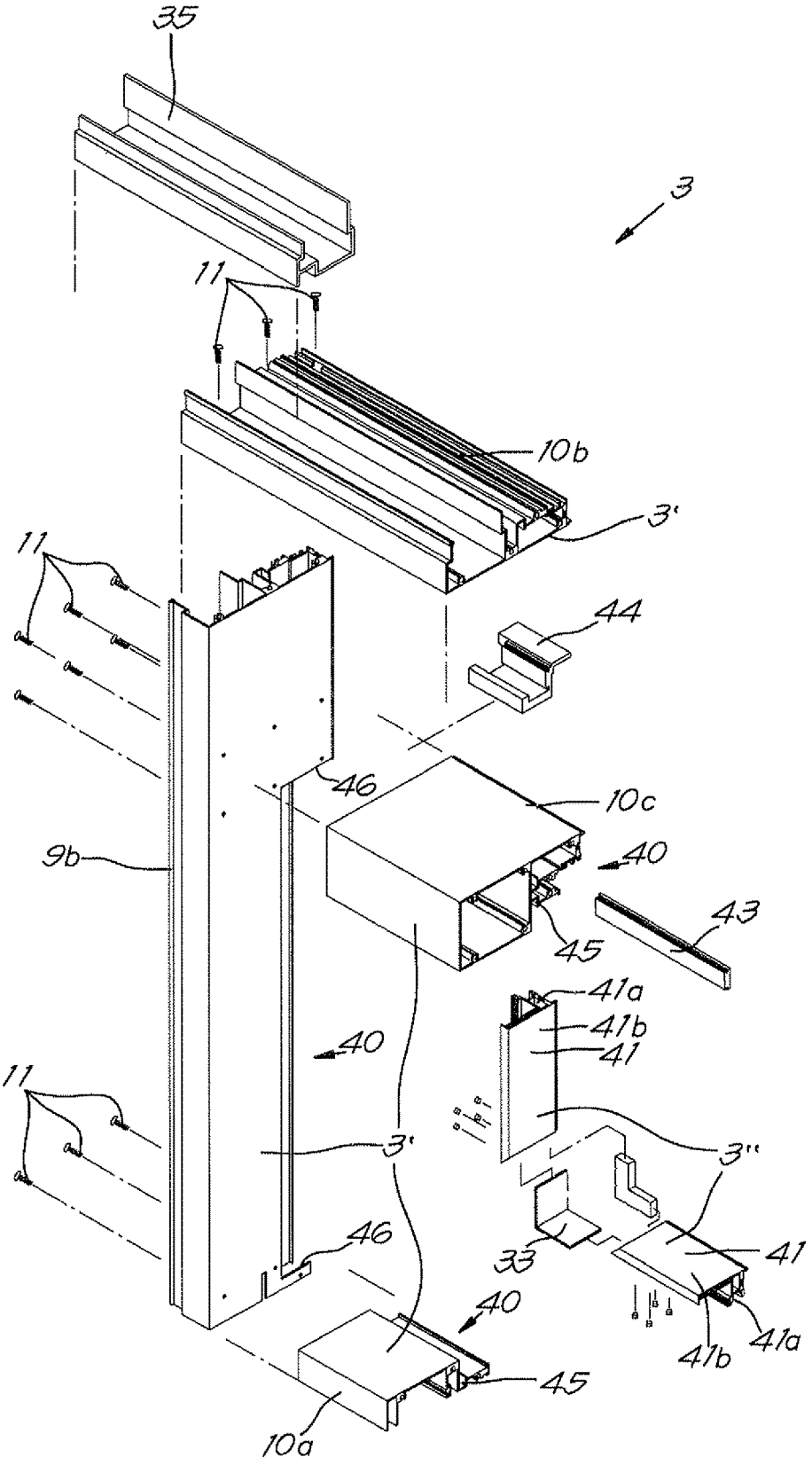
FIG. 16 shows the component parts of the frame of a wall element with a wing that opens.

As far as the mullions 9 are concerned the rebate 40 is formed by locally removing the mullions 9 in the basic frame 3 in line with the wing as shown in FIG. 16 whereby a part of the mullions 9 above and below the rebate is retained.

The rebate 40 is formed by opening the internal side chamber 23*b* by locally removing the side wall 20 of the internal side chamber 23*b* as far as the double walled partition 21, the outside wall 19 of the side chamber 23*b* and a part of the connecting wall 24 as far the protrusion 26.

The outward facing sides of the remaining partition 21 and of the protrusion 26 both form a stop for the wing frame 3", and do so with the intervention of a seal 38, respectively 39, to which the seal 38 is attached in the detailing 25 or the partition 21 and the seal 39 is attached to the wing frame 3".

Equally the transoms 10 on the top and bottom side of the winged compartment 3*a* feature an appropriate rebate 40 spanning their entire length.

With the fact that the rebate 40 stretches over the entire length, the transoms 10 made by profiles 10*a* and 10*c* can already allow for such a rebate 40 during fabrication or by using profiles with an internal chamber 23*b* which is opened across the entire length in the same way as for the rebates 40 in the mullions 9.

When ground in this way the mullions, on the one hand, and transoms extruded with the rebate, on the other, of the basic frame 3 thus form the external frame of the window as it were, so that no separate external frame is required to make a window that opens as is the case in traditionally known curtain walls. The invention lies in the fact that by applying the grinding technique to the mullions—where required in a wall compartment 3*a* featuring a wing that opens—, in the adjoining compartment or in the adjoining compartments of the same wall module and featuring a fixed infill element, no additional frame is required around these fixed infill elements in order to be able to place these in the basic frame 3, contrary to all existing systems.

The wing frame 3" of the wing is formed by profiles 41 which are predominantly L-shaped with a leg 41*a* and a leg 41*b*, this wing frame 3" with its outward facing side facing the outer face 7 of the curtain wall 1 with one leg 41*a* using an aforementioned aluminium slat 27 all around being glued against the inside of the infill element that opens 6*a* using a structural silicone 28 and with the other leg 41*b* facing in a perpendicular direction to this internal side.

The seal 39 and a shortened insulation profile 30" are attached to the leg 41*a*.

The rebate 40 is measured with ample room for traditional hardware 42, for example in the form of friction hinges.

For the intermediate transom 10*c* with rebate 40 in line with the protrusions 26 of the remaining connecting walls 24 an extra insulation slat 43 is attached as shown in the FIGS. 13 and 16.

Figure 15:
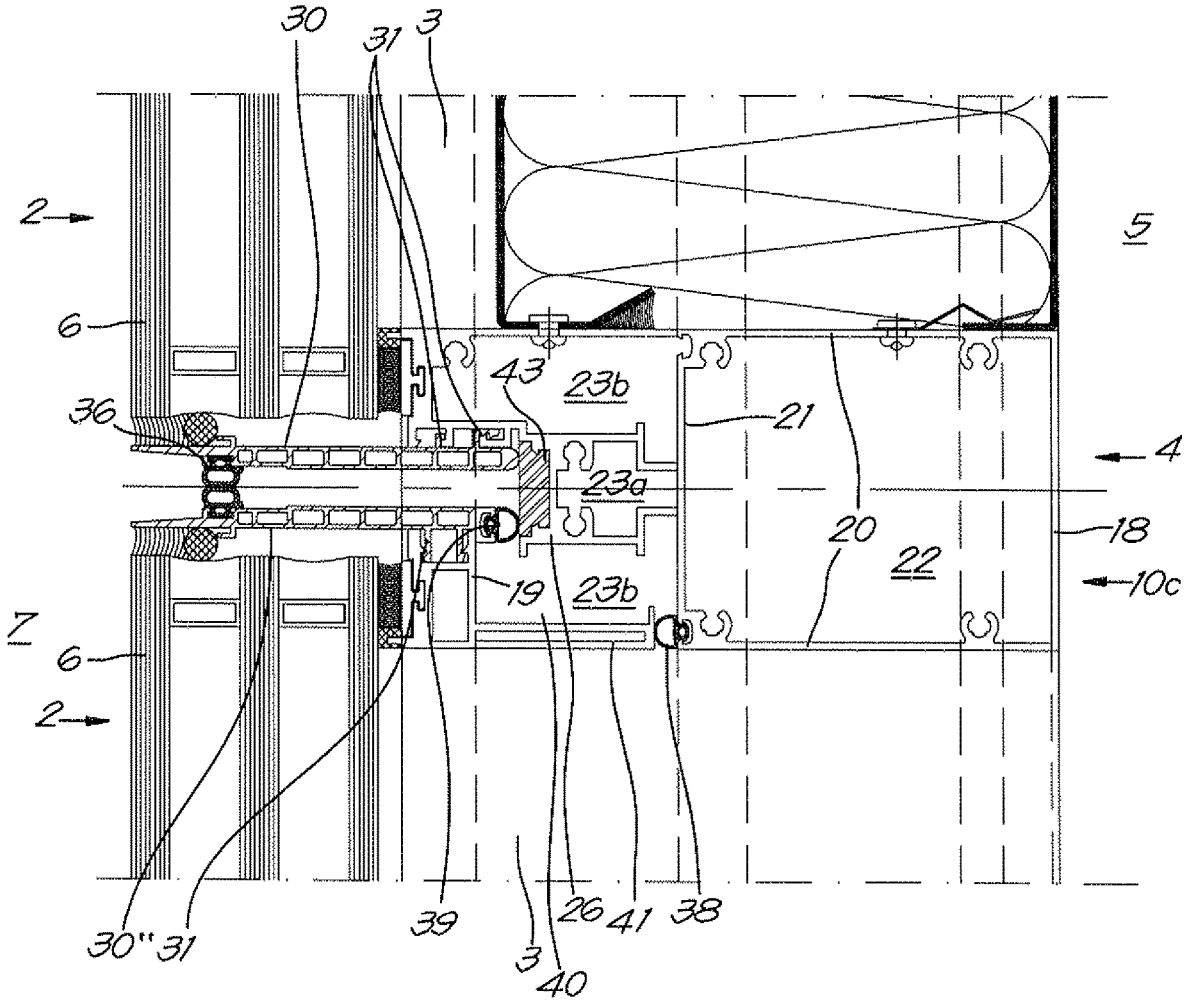
FIG. 15 shows a cross-section according to line XV-XV in FIG. 14.
Figure 14:
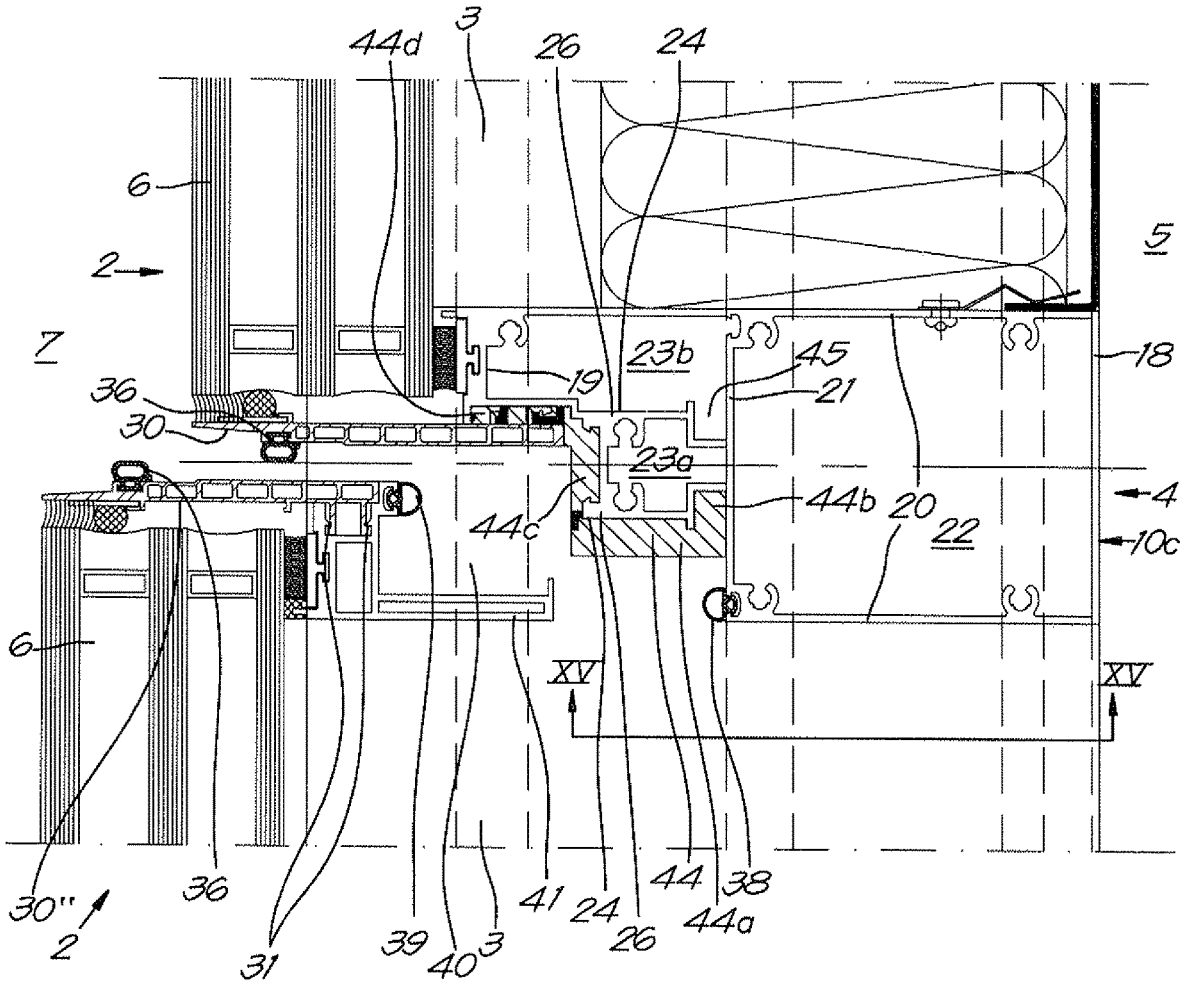
Figure 15:
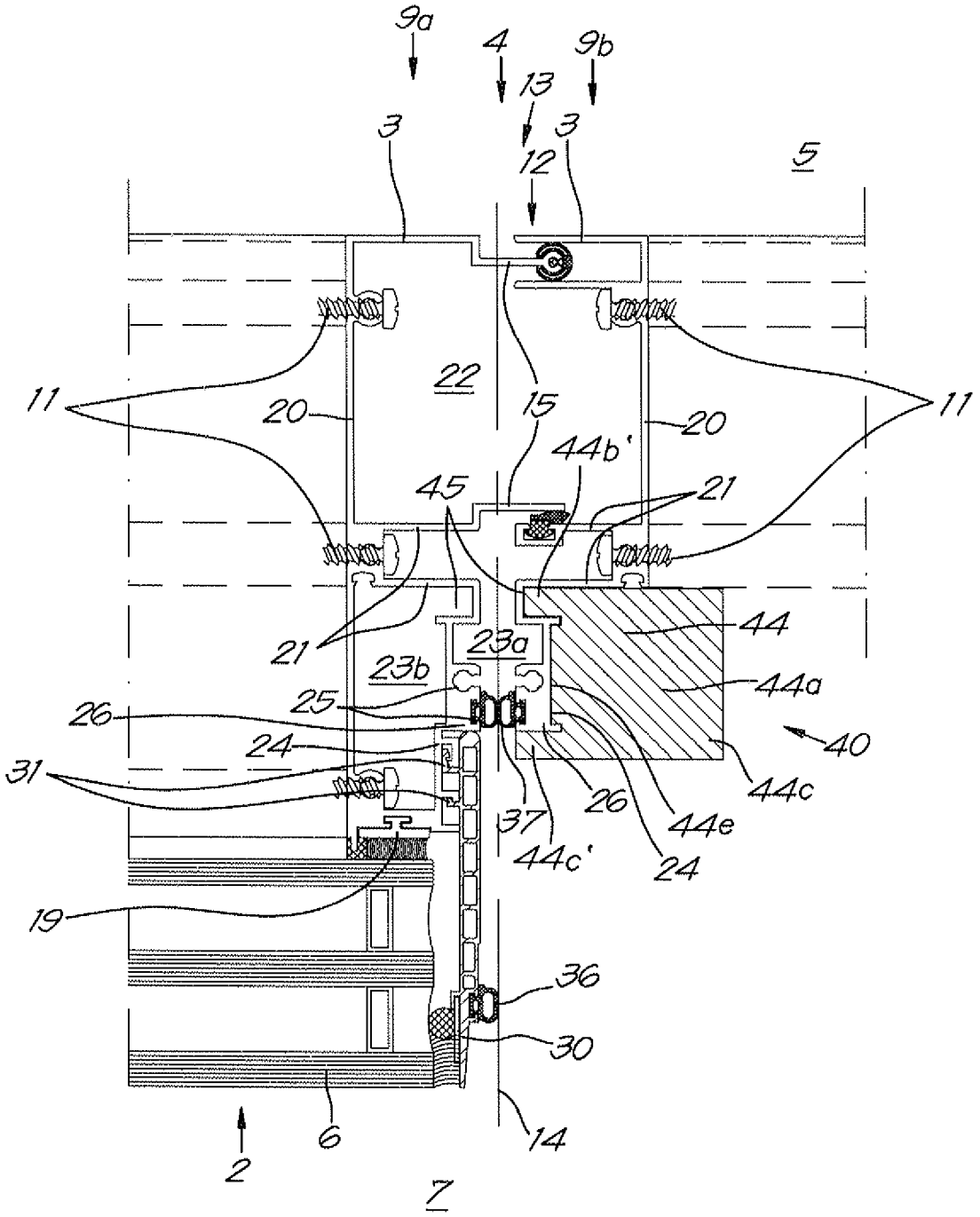
Figure 17:
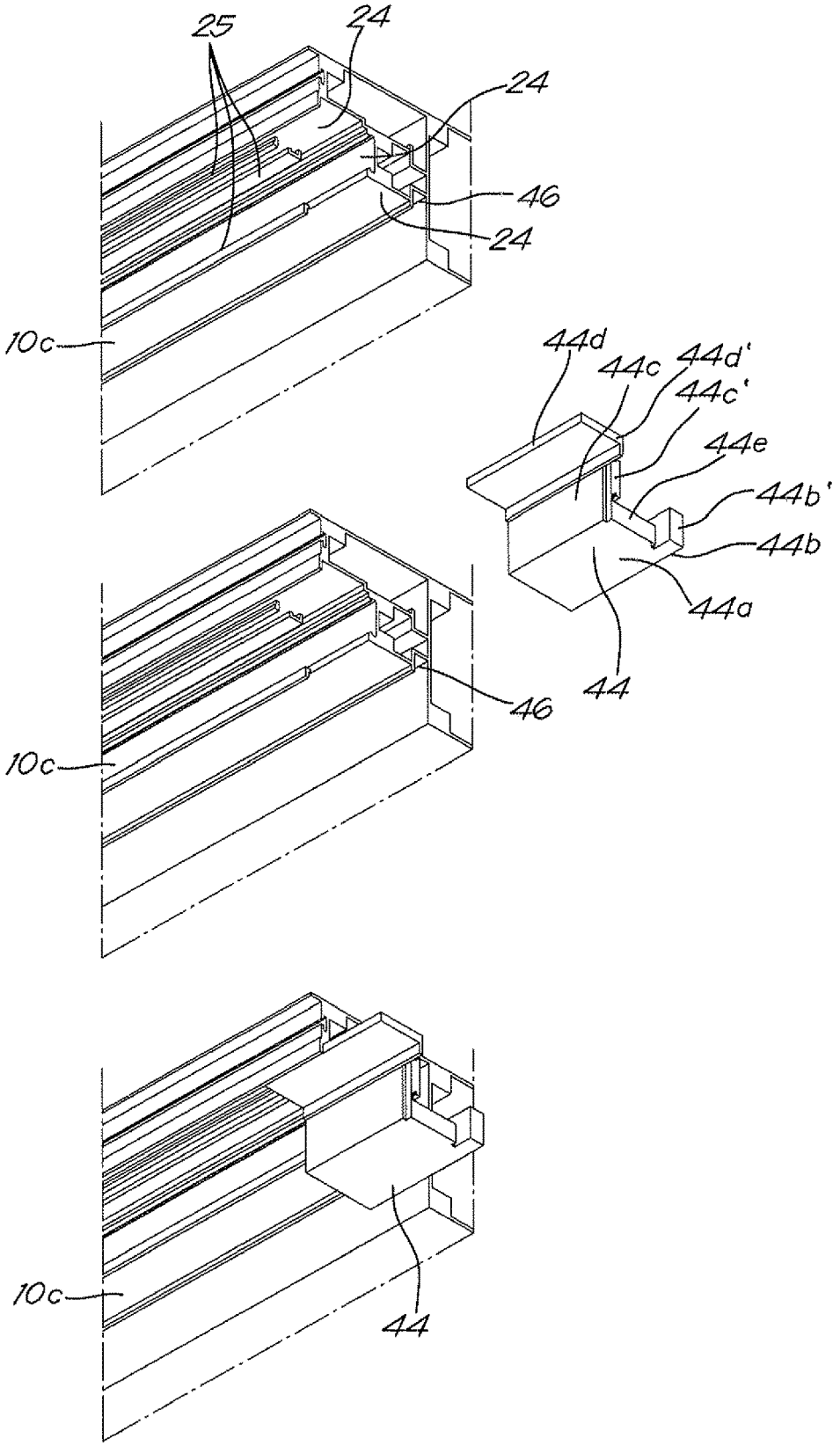
FIGS. 17 and 18 show the way to assemble the component indicated in FIG. 16 with F17.
Figure 18:
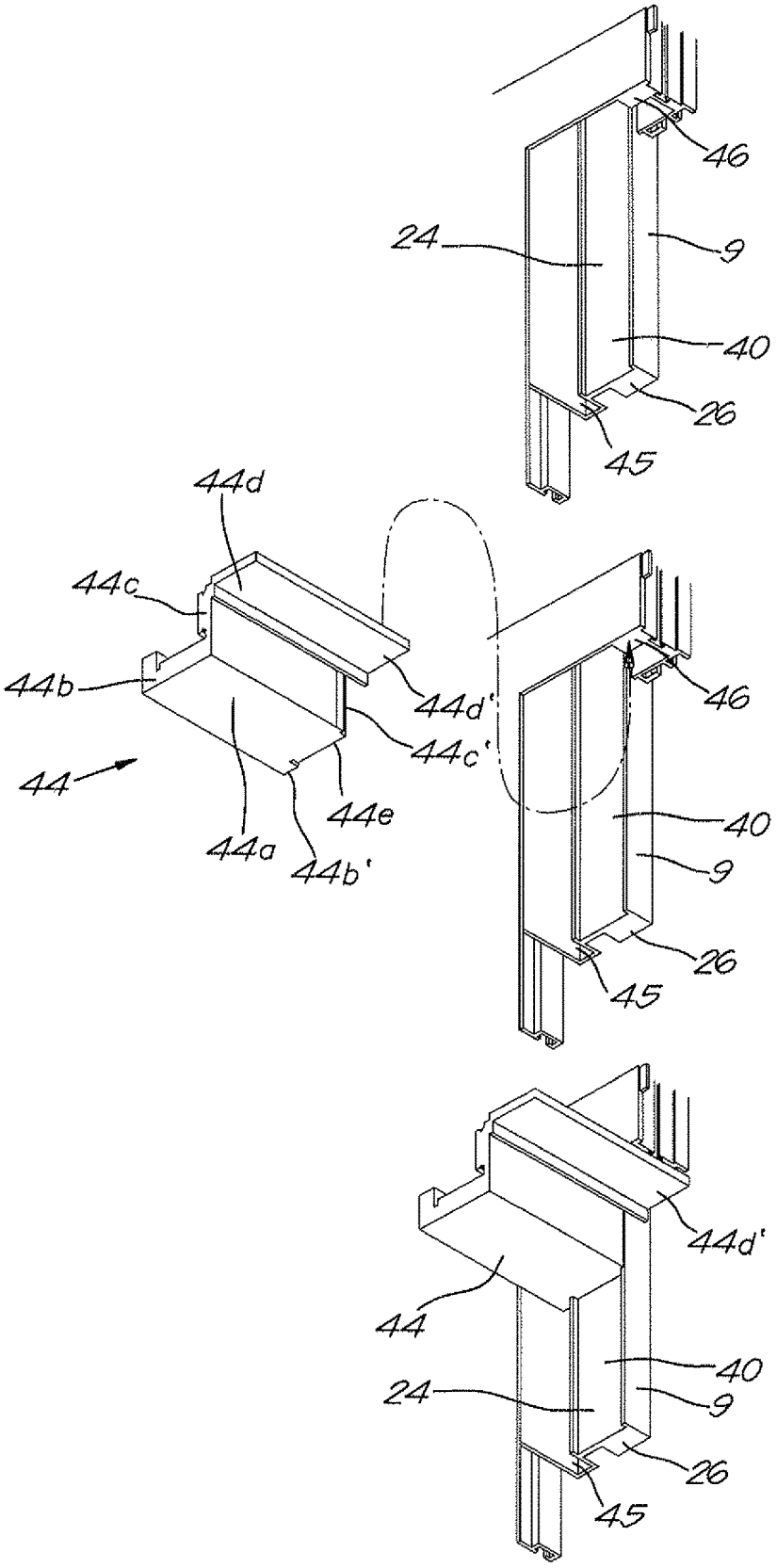

In the corners of the basic frame 3 a sealing corner piece 44 made of rubber, plastic or other sealing material is fitted against the inside of the rebate 40 and this is shown in the cross-sections of the FIGS. 14 and 15 and of which the installation is clarified using the FIGS. 16 to 18.

The corner pieces 40 are intended to perfectly seal the perpendicular corner connections between mullions 9 and transoms 10. After all, wind and rain penetrating the rebate between the basic frame 3 and the wing frame 3" must be stopped from entering the inside 5 of the curtain wall 1 via this corner connection.

The corner piece 44 shown in the figures is formed and sized in such a way that it attaches level with the rebate 40 in the intermediate transom 10*c* against the underside of the remaining connecting walls 24 and against the outside of the remaining protrusions 26 as shown in FIG. 14 and in FIG. 17 at the bottom.

As shown in FIG. 17 certain detailing 25 can therefore be removed in the corners across a particular length M by grinding or suchlike in order to obtain flat surfaces against which the corner piece 44 can be properly attached without the corner piece 44 needing to be made in a complex shape.

The length M across which the detailing 25 is removed can be chosen in such a way that when tightening the transom 10 against a connecting mullion 9 during assembly, the corner piece 44 is clamped between the remaining part of the overlying detailing 25 of the transom 10 and the connecting mullion 9.

As far as the corner pieces 44 in the corners of the intermediate transom 10*c* are concerned, the corner piece 44 in vertical cross-section is predominantly U-shaped with a back 44*a* and a short leg 44*b* and a long leg 44*c* and, on the free edge of the long leg 44*c* an outward stretching lip 44*d* that is perpendicular to this leg 44*c* and which adjoins a connecting wall 24 of a connecting side chamber 23*b*.

The short leg 44*b* therefore sits tightly in an upward-reaching groove 46 of a connecting wall 24 of the intermediate transom 10*c* of the fixed basic frame 3.

In this same way, in the corners of the lowest transom 10*a* an analogue corner piece 44 is attached with the short leg 44*b* fitting into a corresponding downward-facing groove 45 of this transom 10*a* on the basic frame 3.

In the horizontal cross-section of FIG. 15 and in FIG. 18 at the bottom it is possible to see that the corner piece 44 with a side edge 44*e* of the back 44*a* connects against the remaining part of the connecting wall 24 of the rebate 40.

The short leg 44*b* is extended sideways past the edge 44*e* of the back 44*a* and sits sideways with this extended part 44*b*' contained sideways in the groove 45 of a mullion 9.

The long leg 44*c* is also extended sideways and uses this extended part 44*c*' to grip across the protrusion 26 of the remaining connecting wall 24.

Also, the lip 44*d* is extended with a part 44*d*' beyond the edge 44*e* into the rebate 40 of the connecting mullion 9, thus buffed up against the cut edges 46 which limit the rebate 40 in the mullions on the top and bottom.

The corner pieces 44 are preferably glued into the fixed basic frame 3.

It is clear that a corner piece 44 for connection to the left-hand mullion 9 is the mirror image of the corner piece 44 of the figures for connection to the right-hand mullion 9.

It is clear that the corner pieces for the lowest transom 10*a* must vary somewhat from the corner piece 44 of the figures.

As the corner pieces 44 are made of rubber or another supple or semi-supple sealing material, these corner pieces 44 can cope with differential settings and the potential warping or distortion of the basic frame 3 without harming the water and airtight function and are able to do this without the use of any silicone or other kit material.

The corner pieces 44 are attached during the wall builder's production process in the factory and consequently under perfect quality control. As such, for example, the corner pieces are slid onto the ends of the transoms during production before the transoms are attached between the mullions 9 and are screwed tightly in-between.

When the wing is opened the corner pieces 44 become visible, but this causes no problem. A curtain wall 1 system according to the invention is particularly well-suited to the prefabrication of wall elements 2, be these fixed wall elements with fixed infill elements 6 or wall elements with a wing that opens, on an automated production line under working conditions that can be accurately controlled, therefore guaranteeing a perfect finish.

Figure 19A:
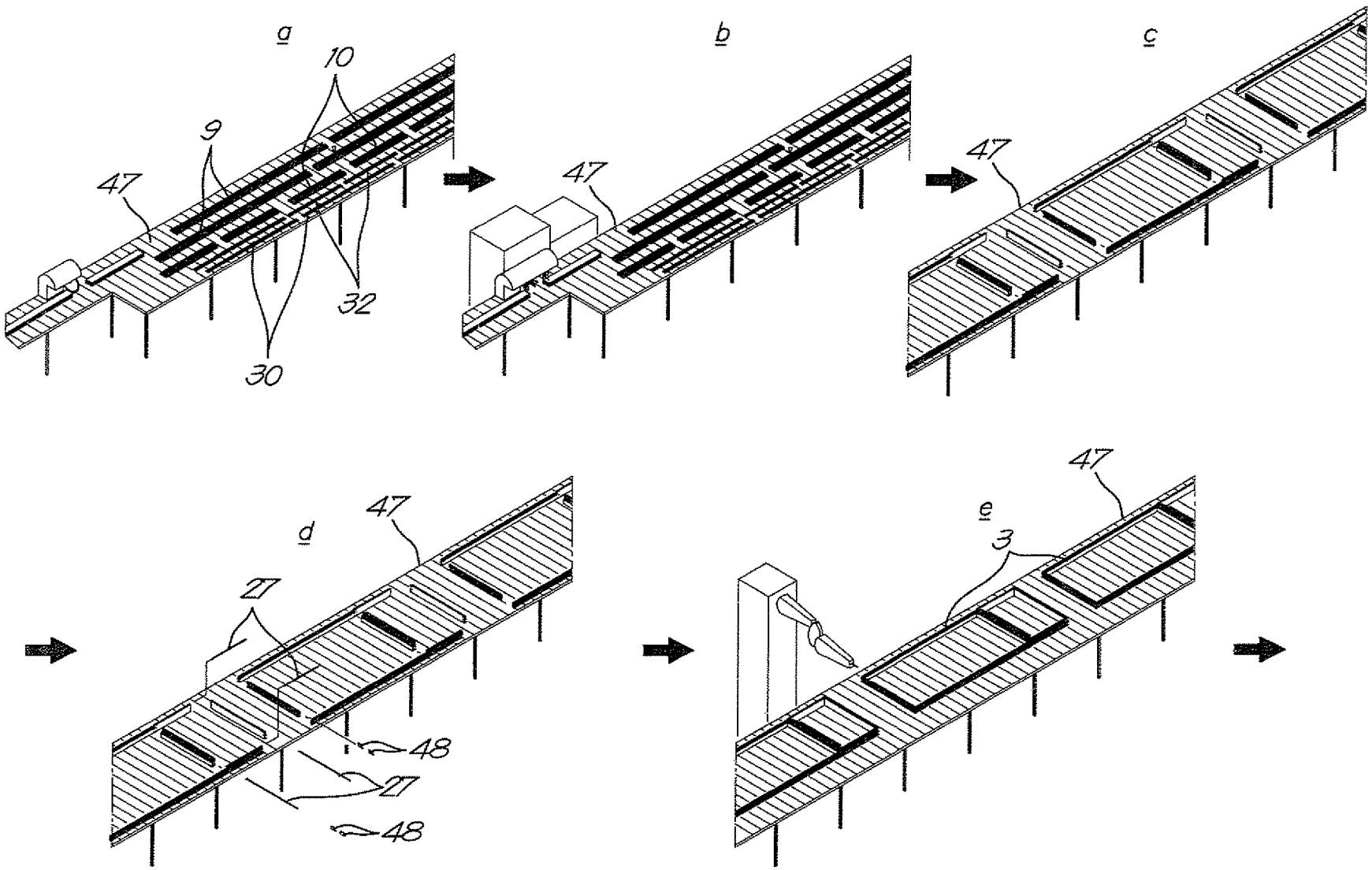
FIGS. 19A and 19B show a production line for the manufacture of wall elements according to the invention.
Figure 19B:
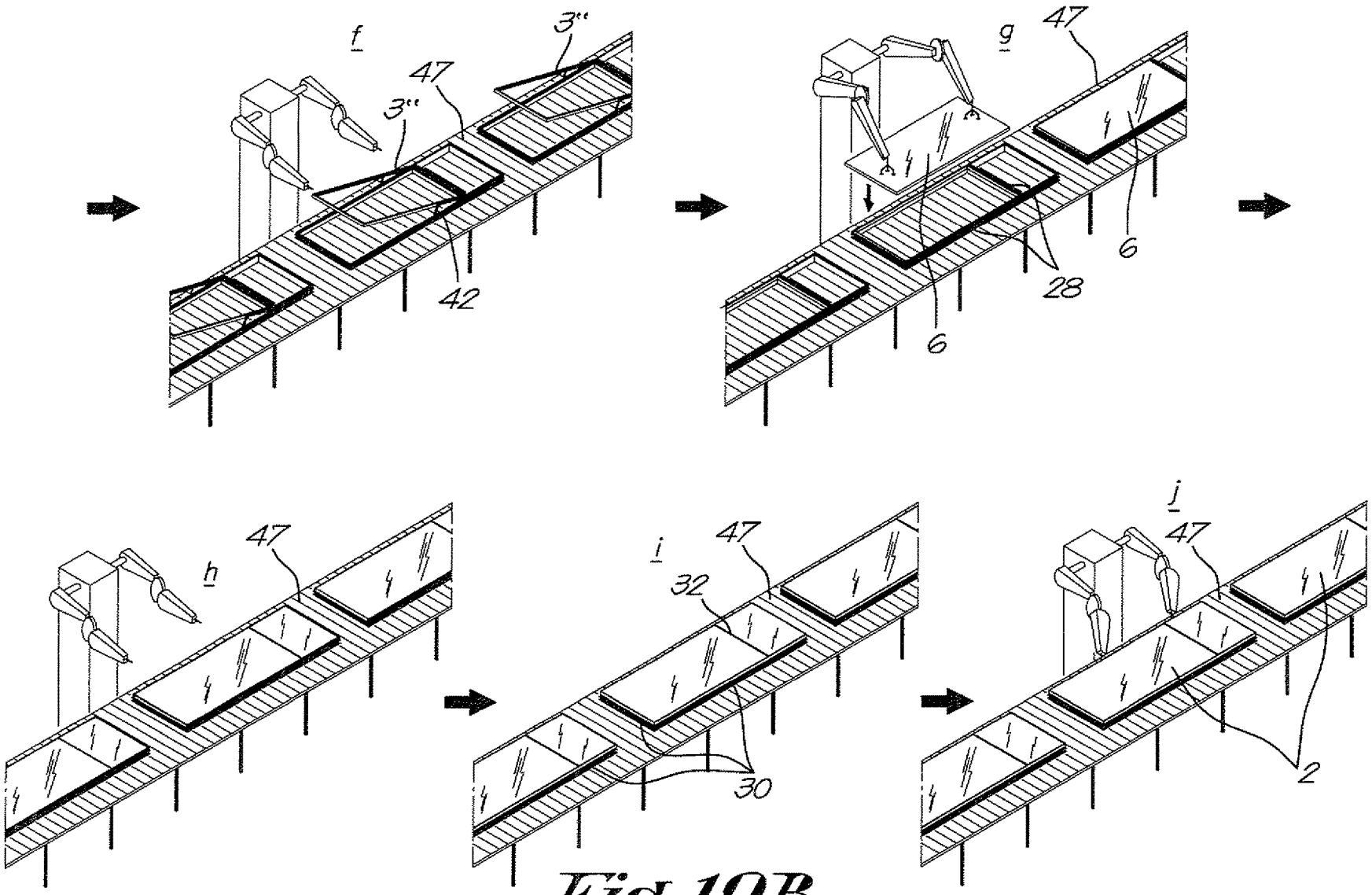

Such a production line is shown in a diagram in the FIGS. 19A and 19B in which use is made of a production line 47.

The production of the glazed wall elements 2 is carried out in the ten consecutive steps a through j as shown in FIG. 19:

a/ cutting all the profiles of the mullions 9 and transoms 10 and the insulation profiles 30 and 32 to the right length;

b/ machining, and if necessary grinding, the profiles using an automated machining device to create a rebate 40;

c/ positioning the profiles on the production line 47 with the inside of the mullions 9 and transoms 10 facing downwards in a position relative to the frame 3 under fabrication;

d/ sliding in the aluminium slats 27 to allow structural gluing of the infill elements 6 and the attachment of the glass supports 48;

e/ assembling the frames 3 by placing the screws 11 which connect the mullions 9 with the transoms 10 and installing all rubber seals 16, 17, 36, 37, 38, 39 and corner pieces 44;

f/ placing the wing frames 3" for the wings that open and for the required hardware 42 in the compartments in which a wing that opens is anticipated;

g/ installing the infill elements 6;

h/ applying the structural silicone 28;

i/ placing and securing the insulation profiles 30 and 32 for the thermal break;

j/ sealing the insulation profiles 30 and 32 along the edges of the infill elements 6 with the help of a silicone or other sealing kit.

It should be noted that throughout the entire production process the frames remain flat on the production line and consequently no time-consuming manipulation is required to turn the frames over, something that saves significant amounts of time.

It should also be noted that the prefabricated wall elements 2 are already fitted with all seals during production in a controlled environment, with the exception of the horizontal seal 34 which is only attached during assembly in the curtain wall 1 in a row of in situ wall elements 2 before a following row wall elements is installed.

Figure 20:
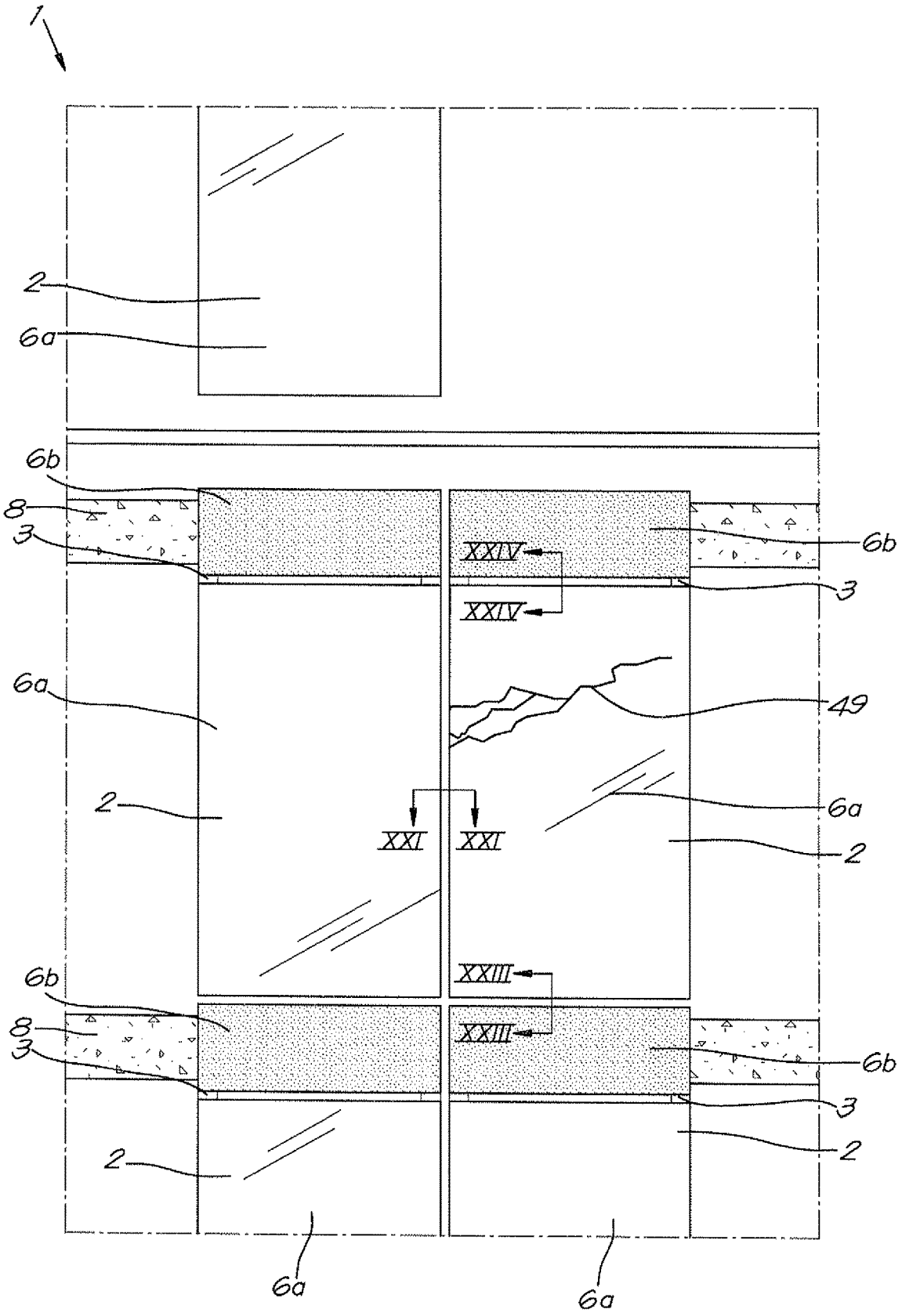
FIG. 20 shows a situation such as the one in FIG. 12 but whereby one wall element displays a cracked or damaged infill element that requires replacement.

Furthermore, the system of a curtain wall 1 according to the invention is highly suitable for the replacement of a fixed infill element 6*a*, for example due to damage or a crack 49 in the infill element 6*a* in a compartment 3*a* as shown in FIG. 20 or for whatever other reason.

Figure 11:
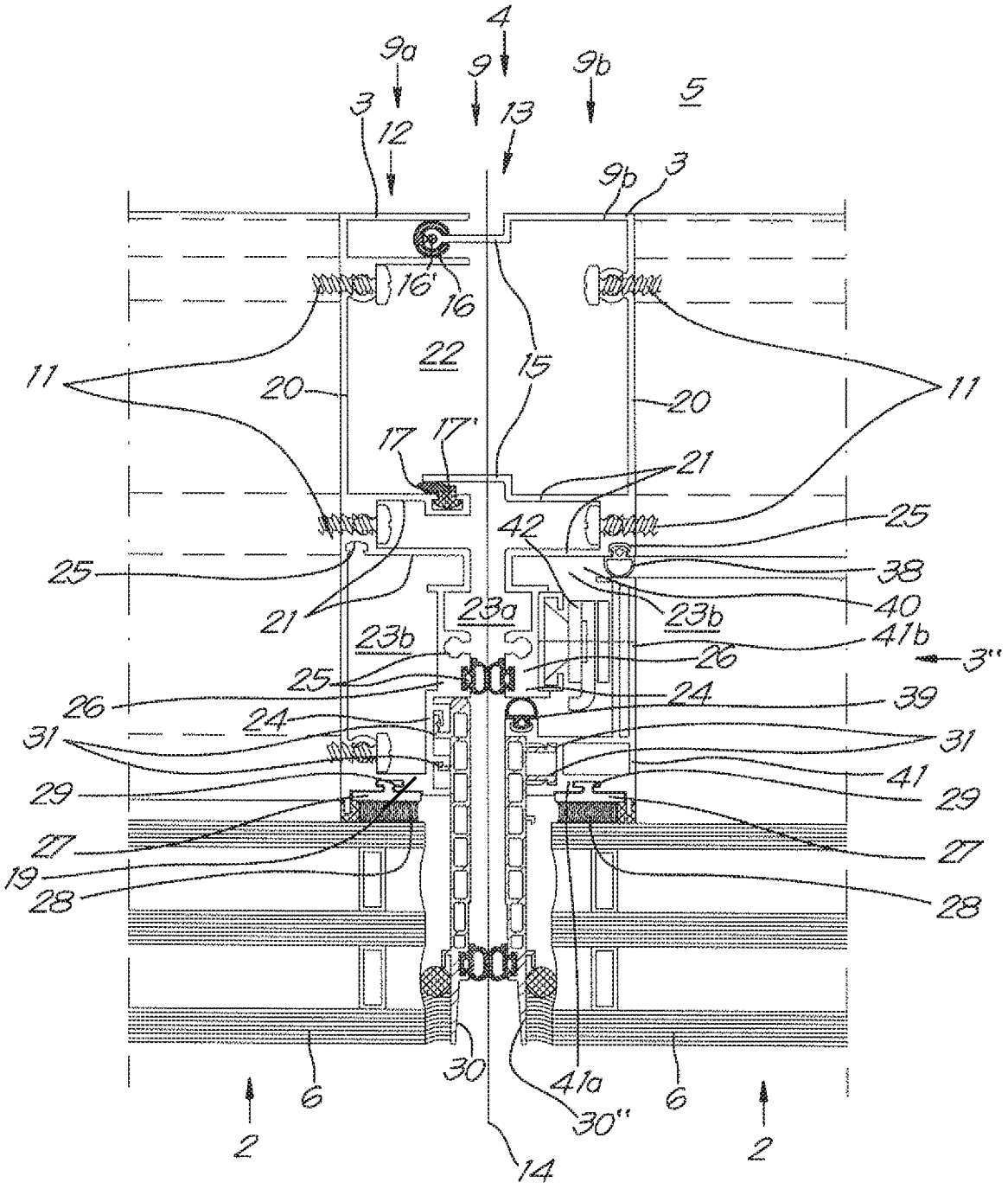
Figure 12:
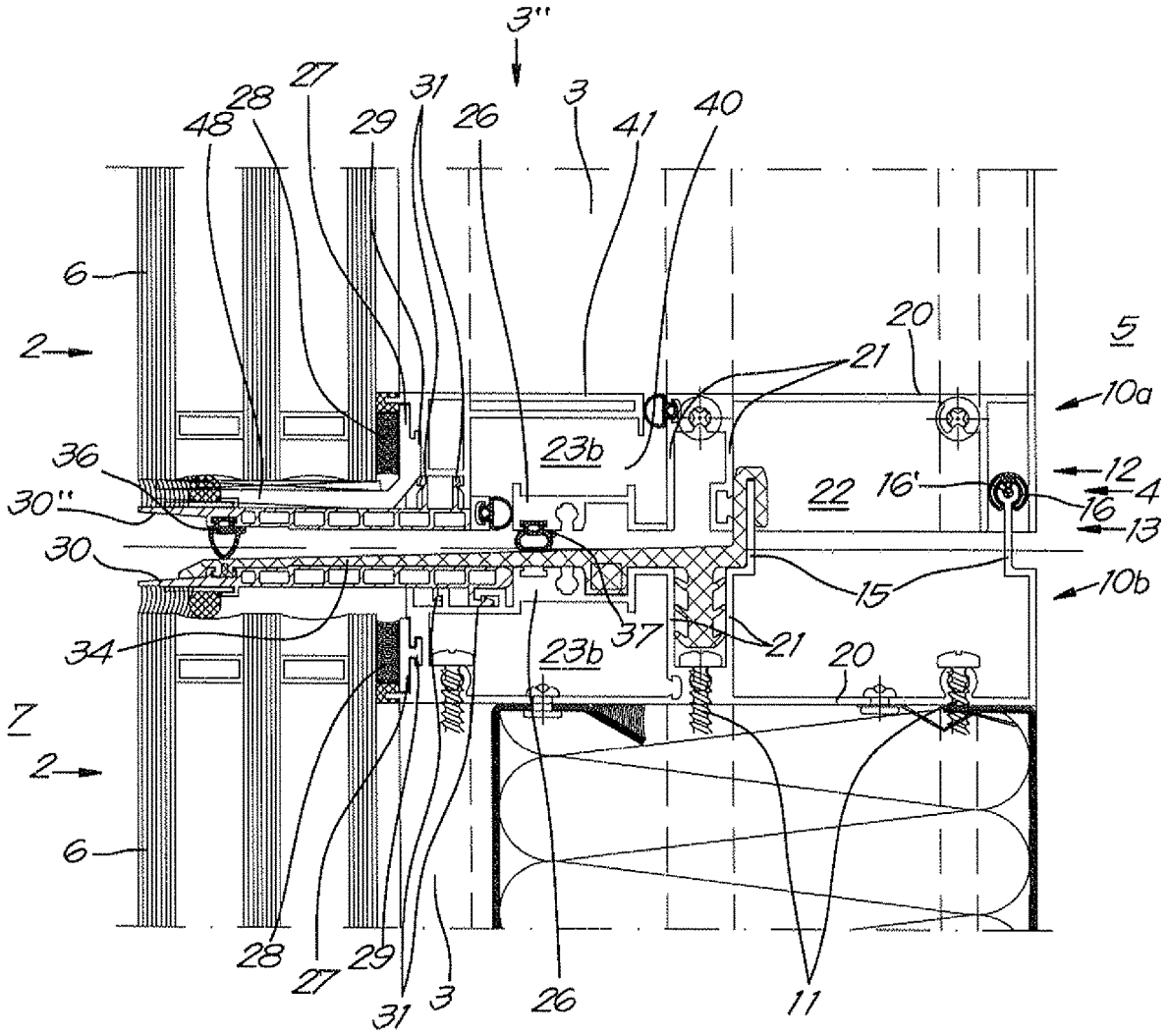
Figure 22:
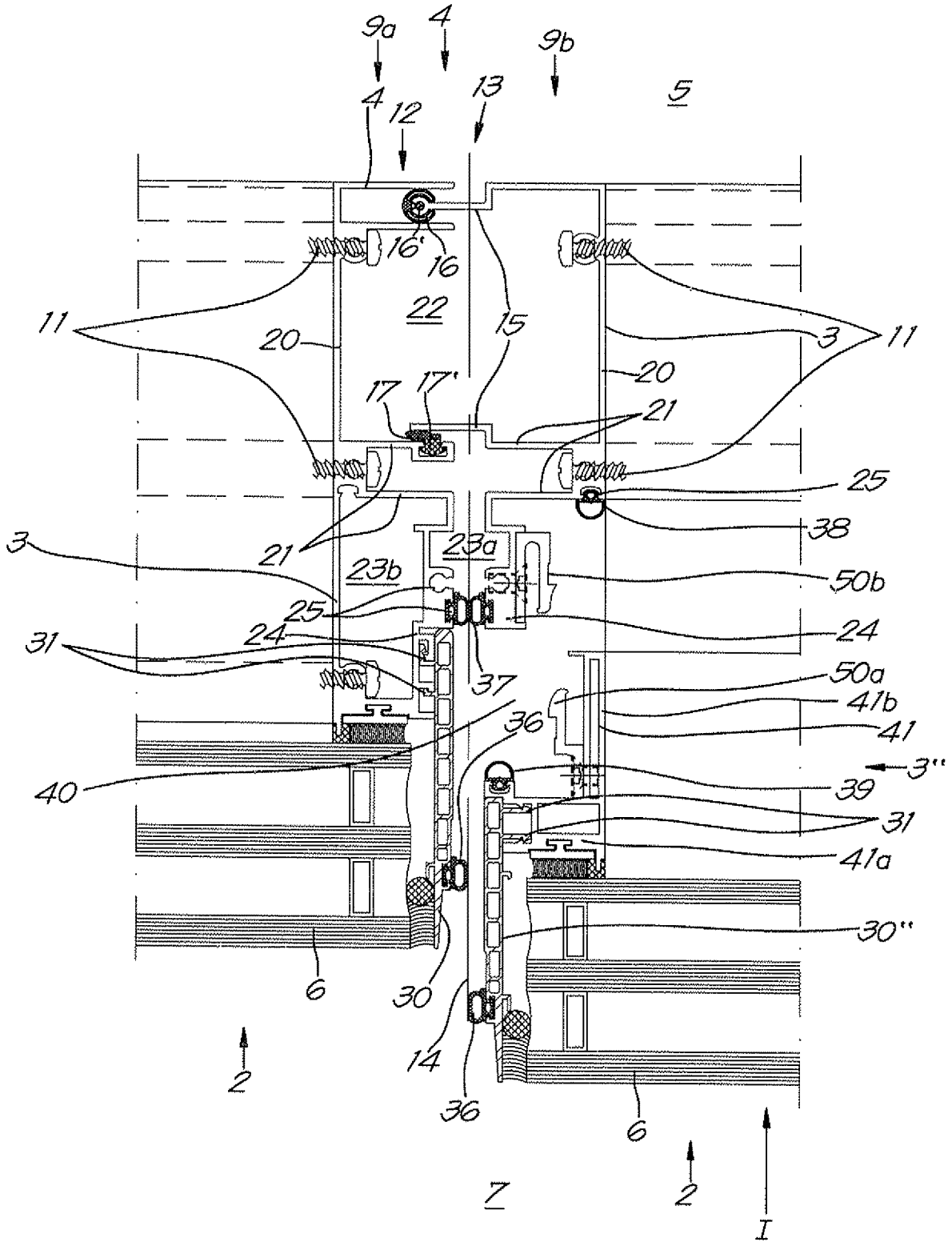
Figure 23:
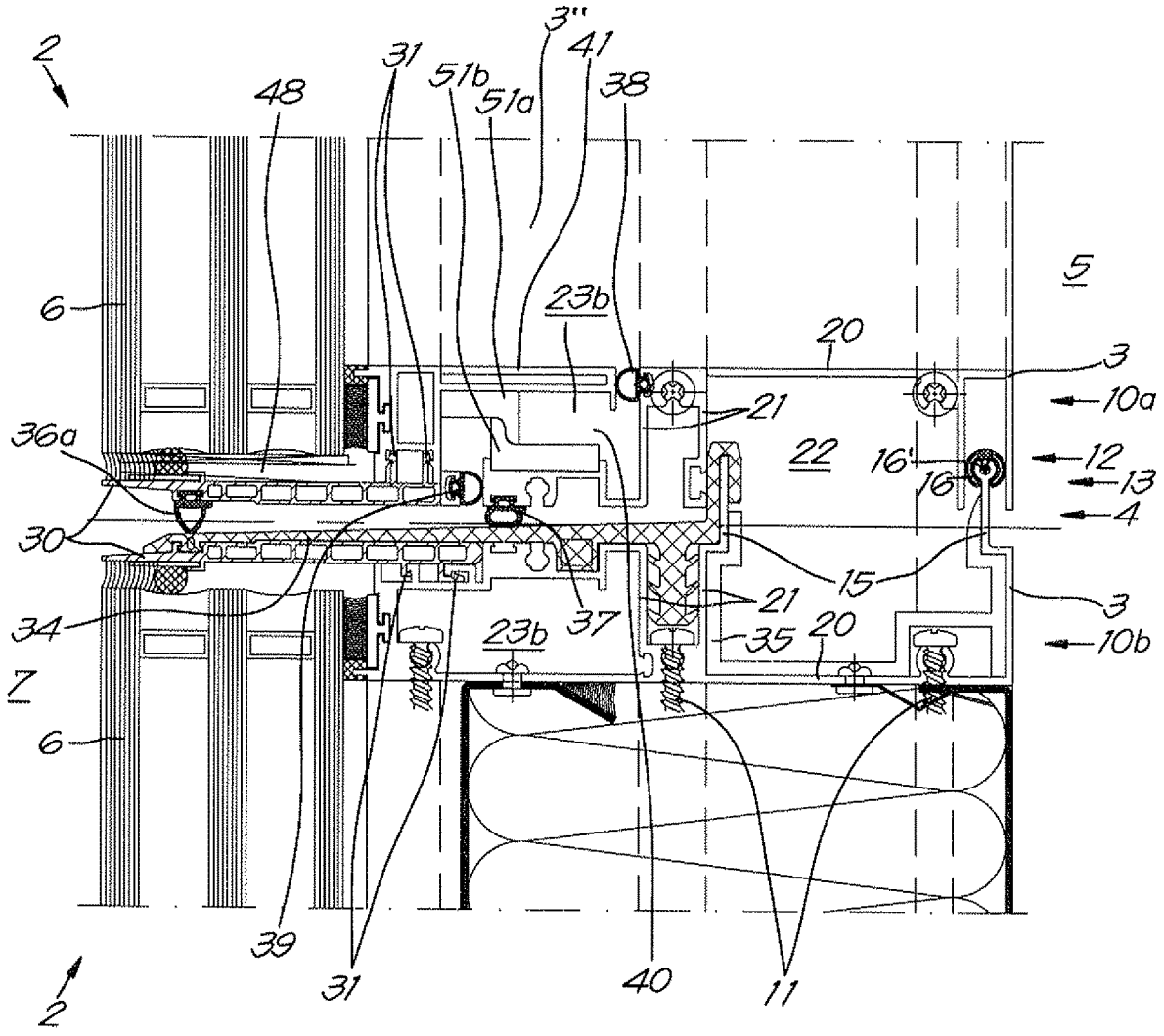
FIGS. 23 and 24 respectively show a cross-section according to the lines XXIII-XXIII and XXIV-XXIV in FIG. 20 but after the replacement of the damaged infill element.
Figure 24:
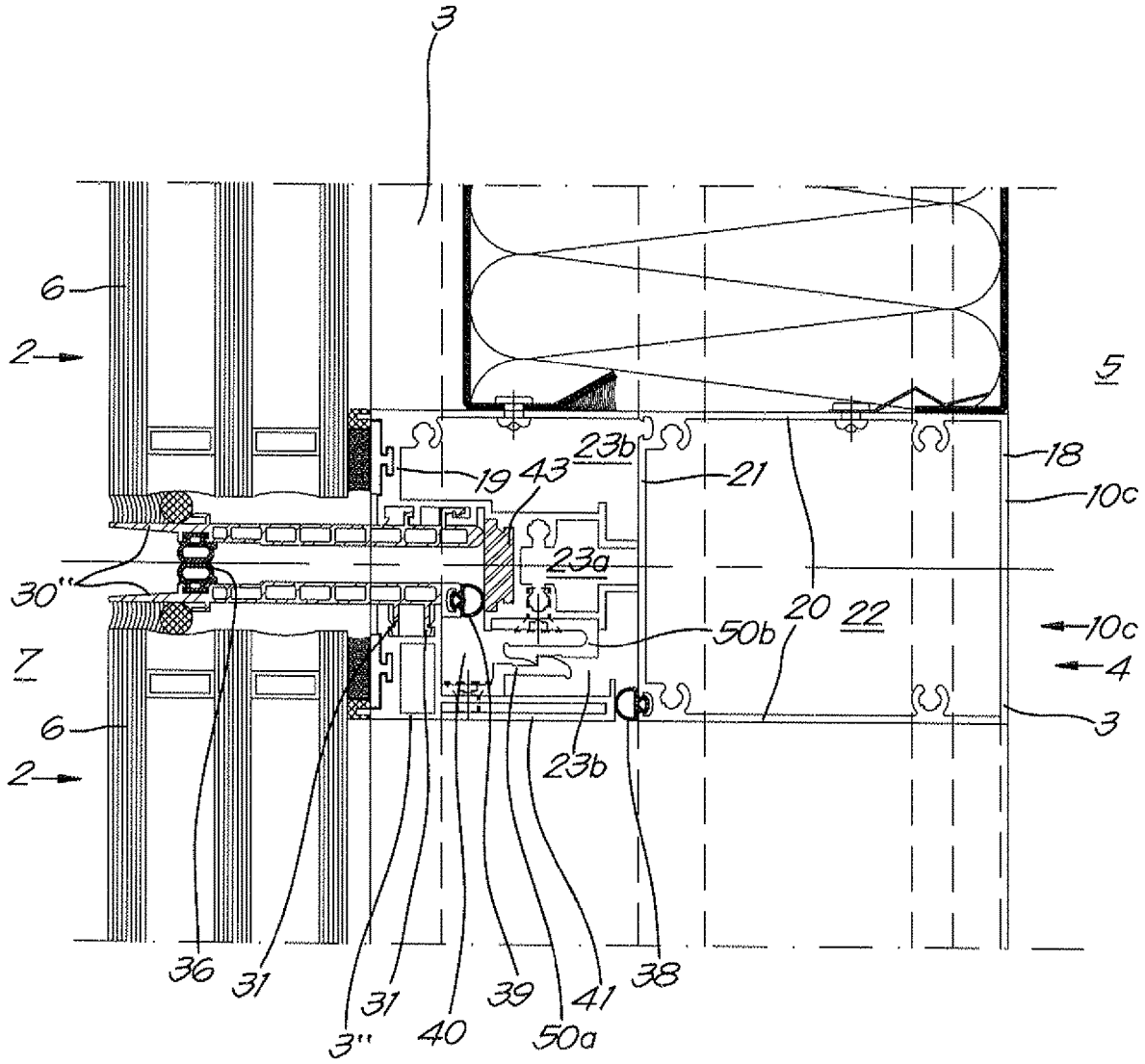

To this end a wing frame 3" with a replacement infill element 6*a* is fabricated beforehand as shown in the FIGS. 22 to 24, similar to the wing frame 3" in FIG. 11 for a wing that opens consisting of L-shaped profiles 41 with the required insulation profiles 30" sealed along the edges of the infill element 6*a* and fitted with seals 36 and 39 all around.

The L-shaped profiles 41 on the leg 41*b* are fitted with a sideways elastic clip connection 50*a* on the vertical profiles 41 as shown in FIG. 22 and on the uppermost profile 41 of the wing frame 3" as shown in FIG. 24 and on the lowest profile 41 of the wing frame 3" a reinforcement lug 51*a* with a downwards-facing lip as shown in FIG. 23.

In order to remove the broken infill element 6*a*, use is first made from the inside of one or several suction cups applied to the inside of the broken infill element in order to hold and manipulate the infill element from the inside. In doing so the suction cups are attached to the inside of the building making it impossible for the infill element for replacement 6*a* to fall down.

Figure 21:
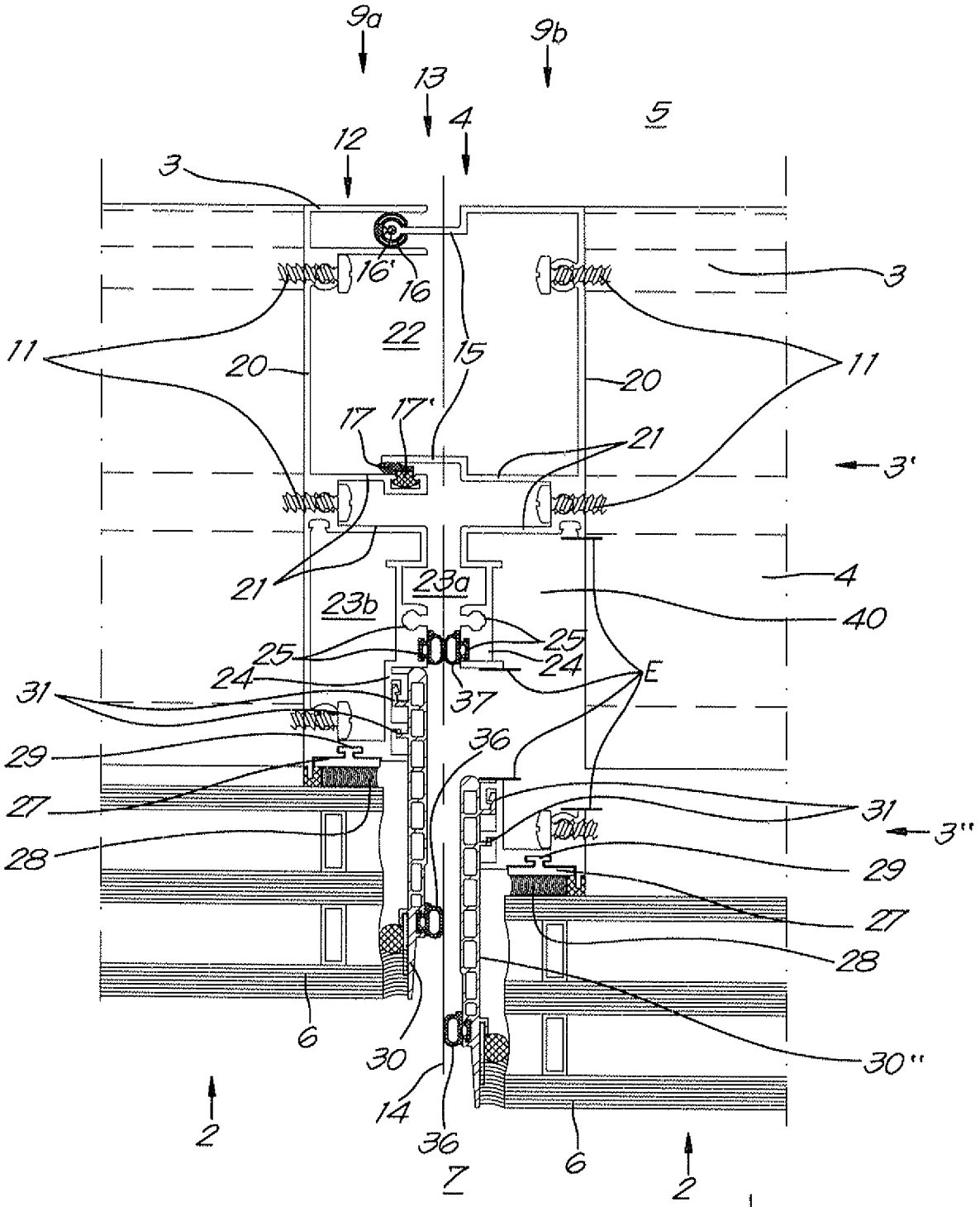
FIGS. 21 and 22 show a cross-section according to the lines XXI-XXI in FIG. 20 during two consecutive steps in the replacement of a cracked or damaged infill element.

Then the basic frame 3 around the broken infill element 6*a* is sawed or ground along the lines E as shown in FIG. 21, whereby the infill element for replacement 6*a* can be removed with a part of the basic frame 3 as shown with arrow O in FIG. 21 and a rebate 40 remains in the remaining part of the basic frame 3.

In the corners of the rebate 40 appropriate corner pieces 44 are applied and one or more, preferably two complementary clip connections 50*b* are attached with screws or suchlike at the level of the mullions 9 and of the upper transom 10*c* of the compartment 3*a* of the infill element for replacement 6*a* and one or more complementary reinforcement lugs 51*b* on the lower transom 10*a*, each reinforcement lug 51*b* with an upward-facing lip behind which the downward-facing lip of the reinforcement lug 51*a* of the wing with the replacement infill element 2 can be hooked as shown in FIG. 23.

Once the broken infill element 6*a* with the attached cut frame part of the basic frame 3 is removed, a seal 38 is then attached in the remaining detailing 25 on the partition 21 and an insulation slat 43 is attached in the intermediate transom 10*c* as shown in FIG. 24.

All that then needs to be done is to attach the tailor-made prefabricated wing frame 3" with the replacement infill element 6*a* first from the inside in the remaining opening in the curtain wall 1, using the aforementioned suction cups, by turning the wing frame 3" from the inside towards the outside and by placing it with reinforcement lugs 51*a* on its lowest profile 41 on the lowest reinforcement lugs 51*b* in the rebate 40 with the lip of the reinforcement lugs 51*a* hooking behind the lip of the reinforcement lugs 51*b*.

Once the wing frame 3" with replacement infill element is placed horizontally in the correct position, this wing frame 3" resting on the reinforcement lugs 51*a* and 51*b* is tipped inside with a rotating pulling movement around the rotation axis through the contact line between the lugs 51*a* and 51*b* as shown with arrow I in FIG. 22, and clipped tight in the curtain wall 1 by hooking the elastic clip connections 50*a* and 50*b* into each other as shown in the FIGS. 22 and 24.

The reinforcement lugs 51*a* and 51*b* are shaped in such a way that the wing frame 3" slides easily into the correct position in the rebate 40 or the basic frame 3.

Throughout the entire operation the installers are inside the building.

The present invention is in no way limited to the example described and the embodiment shown in the figures of a modular curtain wall according to the invention and related 20 wall elements and method for the fabrication of this kind of wall element, but such curtain wall and wall element according to the invention can be realised in all kinds of forms and dimensions without departing from the scope of the invention.

The invention claimed is:

1. A modular type curtain wall, constructed from prefabricated connecting wall elements mounted in rows next to and above each other, wherein each of the wall elements comprises a frame comprising mullions and transoms, said mullions and said transoms defining at least a part of a perimeter for a plurality of open compartments, wherein said plurality of open compartments are formed by at least two of said mullions connected to at least two of said transoms, wherein at least one of the plurality of open compartments is filled using a fixed infill element that is attached directly onto the frame and at least one other of the plurality of open compartments is filled using a wing with an infill element attached on a wing frame that is attached in a rebate formed in at least one mullion forming the frame, wherein the infill elements are all aligned and wherein the mullions of the frames are formed from one-piece profiles with an internal chamber bounded by an outside wall and a side wall of the mullion, wherein in the case that the at least one of the plurality of open compartments is filled with the fixed infill element, the infill element is attached directly against the outside wall of the mullions and wherein in the case that the at least one of the plurality of open compartments is filled with the wing, the rebate in the mullions is formed by locally removing a part of the outside wall and the side wall of the internal chamber of the mullions level with the compartment.

2. The curtain wall of claim 1, wherein the transoms are in the form of one-piece profiles which, for the at least one of the plurality of open compartments filled with the wing, the transoms are equipped during their fabrication with a rebate or which are obtained from one-piece profiles with an internal chamber, wherein an outside wall and side wall of the internal chamber are removed across a entire length of the transom to form the rebate.

3. The curtain wall of claim 1, wherein the mullions and transoms have perpendicular ends, wherein the transoms with their perpendicular ends are attached between the mullions.

4. The curtain wall of claim 1, wherein the mullions and transoms along an outer perimeter of one of the wall elements are fitted with female coupling parts and with complementary male coupling parts with which adjacent frames can fit into each other.

5. The curtain wall of claim 4, wherein the profiles of the mullions and transoms are such that the female and male coupling parts are found beyond the outer perimeter of the internal chamber, so that these coupling parts remain after removal of the outside wall and side wall to create the rebate.

6. The curtain wall of claim 4, wherein in the case of a compartment with the fixed infill element, said fixed infill element is attached against the outside wall of the transoms and mullions using slats which are stuck to the inside of the infill element using structural silicone.

7. The curtain wall of claim 1, wherein in the case of a compartment with the wing, the infill element on the wing frame is attached using slats which are stuck against the inside of the infill element using structural silicone and wherein when seen from the outside of the curtain wall the compartment of this wing frame is entirely or almost entirely covered by the infill element.

8. The curtain wall of claim 5, wherein an internal chamber is bound by a partition and an adjoining connecting wall which respectively connect to the aforementioned side wall and outside wall of the internal side chamber.

9. The curtain wall of claim 8, wherein the rebate is formed by the partition after removal of the side wall up to the partition to form a first stop for the wing frame and by the connecting wall after partially removing this connecting wall up to a protrusion fitted on this connecting wall to create a second stop for the wing frame.

10. The curtain wall of claim 9, wherein at the site of the stops a seal is fitted against which the wing frame can be drawn.

11. The curtain wall of claim 1, wherein the wing frame is formed by predominantly L-shaped profiles which are attached with a first leg along the edges of the infill element against the inside of this infill element and with the second leg at a distance from these edges.

12. The curtain wall of claim 11, wherein, in an assembled condition, the wing frame rests on the protrusion with its first leg with the intervening seal, acting as a stop for the remaining part of the connecting wall of the fixed part frame and rests with the free edge of its second leg with the intervening seal on the partition that acts as a stop.

13. The curtain wall of claim 12, wherein the wall elements are fitted around their perimeter with insulation profiles which are attached to the frame and overlap towards the outside reaching over the edges of the infill elements.

14. The curtain wall of claim 13 wherein, in the case of a compartment with a wing, the insulation profiles are attached to this wing frame.

15. The curtain wall of claim 13, wherein the insulation profiles are sealed against the infill elements using a silicone or other sealing kit.

16. The curtain wall of claim 13, wherein the insulation profiles are fitted along their outside perimeter with a first level of seals at a fixed distance from the outside of the wall elements which ensure a seal against adjoining wall elements and with a seal with the underlying horizontal seal.

17. The curtain wall of claim 16, wherein a second level of seals is fitted on the frame of the wall elements at a greater distance from the outside of the wall elements which ensure a seal against adjoining wall elements.

18. The curtain wall of claim 17, wherein, in the case of the wing, the second level of seals is attached in line with the rebate of the frame.

19. The curtain wall of claim 1, wherein, in the case of a wall element with a compartment with a wing, the rebate in the corners where the ends of the transom profiles connect to the mullion profiles is sealed using an external corner piece that is attached in a way that overlaps in the rebate of the transom profiles and that lies with a side edge touching the connecting mullion profile and is fitted with a lip that touches a connecting wall of an adjoining internal chamber and is fitted with an extended part that extends to seal up to the rebate of the connecting mullion profile.

20. The curtain wall of claim 1, wherein, in the case that the wing is one that opens, the wing frame of this wing in the rebate of the frame is attached using window hardware.

21. The curtain wall of claim 1, wherein, in the case that the wing is a wing of a replacement infill element that is attached to a wing frame, the wing frame of the replacing element in the rebate of the frame is attached to this wing frame using clip connections which are compatible with complementary clip connections in the rebate.

22. The curtain wall of claim 21, wherein reinforcement lugs are featured on the lowest transom of the wing frame part of the replacement infill element, with which the wing frame rests on complementary reinforcement lugs in the rebate of the relevant compartment of the frame.

23. A method for the replacement of a fixed infill element of a wall element in a curtain wall of claim 1 in a building, wherein the method comprises the following steps:

- providing a replacement infill element on a frame in the form of a wing frame;
- clamping the infill element for replacement from an inside position of the building to prevent the infill element from falling out of the building;
- loosening the infill element for replacement from the inside by grinding along a perimeter of the infill element, the outside wall, side wall and the connecting wall of the side chamber of the fixed frame to which the infill element is attached in such a way that a rebate is formed in the remaining part of the fixed frame;
- removing the loosened infill element with the loosened part of the fixed frame from the inside;
- applying the replacement infill element with its wing frame in the rebate of the frame from the inside;
- attaching the replacement infill element with its wing frame.

24. The method of claim 23, wherein the wing frame of the replacement infill element on the lowest transom and on the mullions is fitted with clip connections and the lowest transom is fitted with a reinforcement lug and wherein, before the replacement infill element is fitted in the curtain wall, complementary clip connections and reinforcement lugs are attached in the formed rebate which can cooperate with the clip connection and the reinforcement lugs on the wing frame of the replacement infill element for the attachment of the replacement infill element in the curtain wall.

25. The method of claim 24, wherein for the attachment from the inside of the replacement infill element with its wing frame in the rebate of the frame this is brought outside in its entirety and placed on the reinforcement lugs in the rebate in order for the wing frame to then be tipped towards the inside with a pulling movement onto the reinforcement lugs until the clip connections hook into each other.

26. A modular type curtain wall, constructed from prefabricated connecting wall elements mounted in rows next to and above each other, wherein each of the wall elements consist of a frame comprising mullions and transoms, said mullions and transoms defining a perimeter for a plurality of open compartments, wherein said plurality of open compartments are formed by at least two of said mullions connected to at least two of said transoms, wherein at least one of the plurality of open compartments is filled with a fixed infill element that is attached directly onto the frame and another one of the plurality of open compartments is filled with a wing with an infill element attached on a wing frame that is attached in a rebate formed in at least one mullion forming the frame, wherein the infill elements are all aligned and wherein the mullions of the frames are formed from one-piece profiles with an internal chamber bounded by an outside wall and a side wall of the mullion, wherein the at least one of the plurality of open compartments that is filled with the fixed infill element, the infill element is attached directly against the outside wall of the mullions and wherein the at least one other of the plurality of open compartments that is filled with the wing, the rebate in the mullions is formed by locally removing a part of the outside wall and the side wall of the internal chamber of the mullions level with the compartment.

* * * * *